United States Patent [19]

Taguchi et al.

[11] Patent Number: 5,051,348

[45] Date of Patent: Sep. 24, 1991

[54] HEAT-DEVELOPABLE COLOR LIGHT-SENSITIVE MATERIAL

[75] Inventors: Toshiki Taguchi; Ken Kawata, both of Kanagawa, Japan

[73] Assignee: Fuji Photo Film Co., Ltd., Kanagawa, Japan

[21] Appl. No.: 528,382

[22] Filed: May 25, 1990

[30] Foreign Application Priority Data

May 25, 1989 [JP] Japan ..... 1-131763

[51] Int. Cl.[5] ..... G03C 5/54; G03C 1/34

[52] U.S. Cl. ..... 430/559; 430/203; 430/216; 430/219; 430/607; 430/617; 430/955

[58] Field of Search ..... 430/203, 216, 219, 617, 430/955, 607, 559

[56] References Cited

U.S. PATENT DOCUMENTS

| | | | |
|---|---|---|---|
| 4,536,467 | 8/1985 | Sakaguchi et al. | 430/203 |
| 4,550,071 | 10/1985 | Acno et al. | 430/203 |
| 4,555,470 | 11/1985 | Sakaguchi et al. | 430/203 |
| 4,555,476 | 11/1985 | Sakaguchi et al. | 430/203 |
| 4,587,206 | 5/1986 | Sakaguchi et al. | 430/203 |
| 4,626,499 | 12/1986 | Kato et al. | 430/203 |
| 4,740,445 | 4/1988 | Hirai et al. | 430/203 |
| 4,772,544 | 9/1988 | Hirai | 430/203 |
| 4,783,396 | 11/1988 | Nakamura et al. | 430/203 |
| 4,880,723 | 11/1989 | Harai et al. | 430/203 |
| 4,880,725 | 11/1989 | Hirai et al. | 430/203 |

*Primary Examiner*—Richard L. Schilling
*Attorney, Agent, or Firm*—Sughrue, Mion, Zinn, Macpeak & Seas

[57] ABSTRACT

A heat-developable color light-sensitive material comprising a support having thereon at least a light-sensitive silver halide, a binder, a dye providing compound capable of releasing or forming a diffusible dye in correspondence or counter-correspondence to a reaction in which silver halide is reduced to silver, a basic metal salt compound which is sparingly soluble in water, and at least one acid precursor compound represented by formula (I) or formula (II):

(I)

(II)

wherein the total number of carbon atoms included in $R^1$ and $R^2$ is at least 10, and $R^1$ and $R^2$ each represents a group represented by formula (III) or formula (IV):

(III)

(IV)

wherein $R^{11}$, $R^{12}$, $R^{13}$, $R^{14}$, $R^{15}$, $R^{16}$, $R^{17}$ and $R^{18}$ each represents a substituent, provided that $R^1$ and $R^2$ are selected such that the sum of the aliphatic Taft's constants ($\sigma^*$ value) of the substituents represented by formula (III), the Taft's constants ($\sigma-$value) of $R^{14}$ and $R^{18}$, the Hammett's constants ($\sigma_m$ value) of $R^{15}$ and $R^{17}$, and the Hammett'constant ($\sigma_p$ value) of $R^{16}$ is 0 or more.

The heat-developable color light-sensitive material is excellent in preservability before imagewise exposure and provides color images having a high maximum density and a low level of stain.

21 Claims, No Drawings

HEAT-DEVELOPABLE COLOR LIGHT-SENSITIVE MATERIAL

FIELD OF THE INVENTION

The present invention relates to a heat-developable color light-sensitive material. More particularly, it relates to a heat-developable color light-sensitive material which is excellent in preservability before imagewise exposure and provides color images having a high maximum density and a low level of stain.

BACKGROUND OF THE INVENTION

Heat-developable light-sensitive materials are known in the art. For example, conventional heat-developable light-sensitive materials and heat-development processes are described in *Shashinkogaku no Kiso*, "Edition of Higin-en Shashin", pages 242 to 255 (Corona Co., Ltd., 1982).

Many different processes for forming color image utilizing heat development have been proposed. Processes for forming color images by the reaction of an oxidation product of a developing agent with a coupler, are described, for example, in U.S. Pat. Nos. 3,531,286, 3,761,270 and 4,021,240, Belgian Patent 802,519 and *Research Disclosure*, pages 31 to 32 (September, 1975).

However, since the above-described heat-developable light-sensitive materials used for obtaining color image are non-fixing type, silver halide undesirably remains in the light-sensitive material after image formation. The remaining silver halide causes a severe problem in that coloration gradually occurs in white background areas when exposed to strong light or stored for a long period of time. Further, the above-described color image forming processes generally require a relatively long period of time for development. Additionally, the color images formed are unsatisfactory due to a high level of fog and a low image density.

In order to solve these problems, processes have been proposed wherein diffusible dyes are imagewise formed or released upon heating, and the diffusible dyes are transferred to an image receiving material containing a mordant with a solvent such as water, as described, for example, in U.S. Pat. Nos. 4,500,626, 4,483,914, 4,503,137 and 4,559,290 and JP-A-59-165054 (the term "JP-A" as used herein means an "unexamined published Japanese patent application").

However, these processes require a relatively high temperature for heat development. In addition, stability of the light-sensitive materials during preservation is still insufficient. Thus, for the purpose of accelerating development, lowering temperature of development and making processing simple, processes have been proposed in which heat development and transfer of dye are performed in the presence of a base or base precursor and a slight amount of water, as disclosed, for example, in JP-A-59-218443, JP-A-61-238056, 61-238056, and European Patent 210,660A2.

With respect to processes for obtaining positive color images utilizing heat development, many methods have been proposed. For instance, in U.S. Pat. No. 4,559,290, a method is described wherein an oxidized compound, which in its oxidized state does not have a dye releasing ability and is obtained by converting a so-called DRR compound, is coexistent with a reducing agent (including a precursor thereof), the reducing agent is oxidized upon heat development in correspondence to an exposure amount of silver halide, and the oxidized compound obtained from the DRR compound is reduced with the remaining reducing agent which has been not oxidized, whereby a diffusible dye is released. Further, in EP-A-220746 and *Kokai Giho* 87-6199 (Vol. 12, No. 22), a heat-developable color light-sensitive material containing, as a compound capable of releasing a diffusible dye in a similar mechanism to that disclosed in U.S. Pat. No. 4,559,290, a compound is described which can release a diffusible dye upon reductive cleavage of an N-X bond (wherein X represents an oxygen atom, a nitrogen atom or a sulfur atom).

In the above-described heat-developable color light-sensitive materials, dye providing compounds are included which react under a relatively high pH condition during development processing and generate a dye necessary for forming an image. However, if the dye generating reaction inadvertently occurs during storage or handling of the light-sensitive material, stain increases in a white background area of the image, and thus discrimination of image is diminished. It has been found that the increase in stain is particularly apt to occur when a basic metal salt compound coexists with the dye-providing compound in a layer of the light-sensitive material. The main reason for this phenomenum is attributed to an increase in pH of the layer of the light-sensitive material during preservation.

It has also been found that various other related problems may occur due to the increase in pH of the layer of the light-sensitive material in addition to the above described dye generating reaction. Specifically, organic compounds incorporated into the layer are oxidized by air to form stain.

SUMMARY OF THE INVENTION

Therefore, an object of the present invention is to provide a heat-developable color light-sensitive material which is excellent in preservability before imagewise exposure. More specifically, an object of the present invention is to provide a heat-developable color light-sensitive material which can form color images having a high image density and a low level of stain both immediately after the production thereof and after the preservation (storage and handling) thereof.

Other objects of the present invention will become apparent from the following detailed description and examples.

These objects of the present invention are accomplished with a heat-developable color light-sensitive material comprising a support having thereon at least a light-sensitive silver halide, a binder, a dye providing compound capable of releasing or forming a diffusible dye in correspondence or counter-correspondence to a reaction in which silver halide is reduced to silver, a basic metal salt compound which is sparingly soluble in water, and at least one acid precursor compound represented by formula (I) or formula (II):

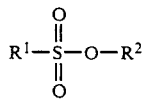

(I)

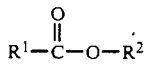

(II)

wherein the total number of carbon atoms included in $R^1$ and $R^2$ is at least 10, and $R^1$ and $R^2$ each represents a group represented by formula (III) or formula (IV):

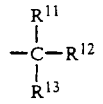

(III)

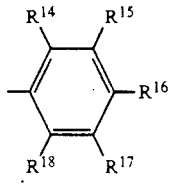

(IV)

wherein $R^{11}$, $R^{12}$, $R^{13}$, $R^{14}$, $R^{15}$, $R^{16}$, $R^{17}$ and $R^{18}$ each represents a substituent (wherein the substituent may be a hydrogen atom), provided that $R^1$ and $R^2$ are selected such that the sum of the aliphatic Taft's constants ($\sigma^*$ value) of the substituents represented by formula (III), the Taft's constants ($\sigma^-$ value) of $R^{14}$ and $R^{18}$, the Hammett's constants ($\sigma_m$ value) of $R^{15}$ and $R^{17}$, and the Hammett's constant ($\sigma_p$ value) of $R^{16}$ is 0 or more.

DETAILED DESCRIPTION OF THE INVENTION

In formulae (III) and (IV) above, the substituents represented by $R^{11}$, $R^{12}$, $R^{13}$, $R^{14}$, $R^{15}$, $R^{16}$, $R^{17}$ and $R^{18}$ can be independently selected from any suitable substituent including a hydrogen atom and a halogen atom limited only by the above-described requirement that the sum of the substituent constants is 0 or more.

In formula (III), $R^{11}$ and $R^{12}$ may combine with each other to form a ring structure.

In formula (IV), two vicinal groups of those represented by $R^{14}$, $R^{15}$, $R^{16}$, $R^{17}$ and $R^{18}$ may combine with each other to form an aromatic ring. In such a case, the positions at which the aromatic ring is formed are excluded from the calculation of the above described substituent constants.

The compounds represented by formula (I) and formula (II) according to the present invention are compounds known as sulfonic acid esters and carboxylic acid esters, respectively. The employment of various sulfonic acid esters and carboxylic acid esters as organic solvents having a high boiling point for emulsification and dispersion of water-insoluble compounds in an oil-protected form is known in the field of art as described, for example, in JP-A-59-178452. The ester compounds employed for this purpose are selected from compounds which are hard to undergo hydrolysis.

In the present invention, the compound represented by formula (I) or formula (II) is employed as an acid precursor. The acid precursor used in the present invention means a compound which releases an acid by heat or hydrolysis.

Techniques of employing sulfonic acid esters or carboxylic acid esters as acid precursors are known. More specifically, the employment of such a compound as a development stopping agent is described in JP-A-61-59335, and the employment of such a compound as a discrimination improving agent at processing is described in JP-A-63-17446.

In order to use the compound represented by formula (I) or formula (II) as an acid precursor suitable for the purpose of the present invention, the compound must have a suitable rate of alkaline hydrolysis during preservation. As a result of the detailed investigations on this particular point, applicants have found that the condition which the compound represented by formula (I) or formula (II) should satisfy is that the sum of the Taft's constants, which are substituent constants applied for substituents on aliphatic groups and aromatic ortho-positions, and the Hammet's constants, which are substituent constants applied for substituents on aromatic metha- and para-positions, both of which are known as electronic parameters of the substituents, is 0 or more, and preferably from 0 to 3.

The above-described Hammett's and Taft's constants for substituents are described in detail, for example, in Imoto, *Riron Yukikagaku Kaisetsu*, Vol. 19, Chapter 20 (Tokyo Kagaku-dozin, 1976) and *Yakubutsu no Kozo-kasseisokan*, a special edition of *Kagaku no Ryoiki*, No. 122, Chapter 2 (Nanko-do, 1979). Particularly in this regard, hydrolysis reactions of esters have been hitherto studied in great detail. In general, the rule of the additivity is involved in determining the value of the substituent constants. Therefore, an electron withdrawing group has a large value of the substituent constant and causes an acceleration of the hydrolysis reaction. For an ester according to the present invention which gradually decomposes to release an acid in the layer of the light-sensitive material, applicants have found that the sum of the substituent constants is preferably from 0 to 3.

In formula (III) or formula (IV), suitable examples of the substituents represented by $R^{11}$ to $R^{18}$ include a hydrogen atom, a halogen atom, a nitro group, a cyano group, an alkyl group, an alkenyl group, an aralkyl group, an aryl group, a heterocyclic group, an alkoxy group, an aryloxy group, an alkyl or aryl thio group, a substituted or unsubstituted carbamoyl group, an alkyl or aryl carbonyl group, an alkyl or aryl sulfonyl group, an alkyl or aryl oxycarbonyl group, an alkyl or aryl carbonyloxy group, a di-substituted amino group substituted with an alkyl group or an aryl group, and a substituted or unsubstituted sulfamoyl group.

When the compounds represented by formula (I) and formula (II) are employed as the acid precursors, they may be used individually or as a combination of any two or more thereof.

In order to incorporate the compound represented by formula (I) or formula (II) into a layer of the light-sensitive material, conventional emulsified dispersion methods can be employed. For instance, the acid precursor can be emulsified individually or in combination with other hydrophobic additives. Further, a known fine particle dispersion method as described, for example, in JP-A-59-174830 can be employed.

The acid precursor according to the present invention can be added to any desired layer in the light-sensitive material such as a light-sensitive layer, a protective layer or an intermediate layer. Also, it can be added to only one layer thereof or any combination of two or more layers thereof.

The amount of the acid precursor to be used can be varied over a wide range, but it is usually from 0.001 mol to 1 mol, preferably from 0.005 mol to 0.2 mol, per mol of the basic metal salt compound used together with the acid precursor.

Specific examples of the compounds represented by formula (I) or formula (II) according to the present invention are set forth below, but the present invention should not be construed as being limited thereto.

Specific examples of the compounds represented by formula (I) are provided below:
AP-1
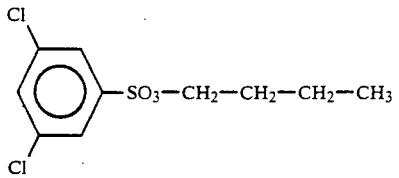
AP-2
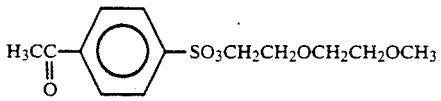
AP-3
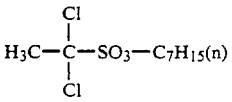
AP-4
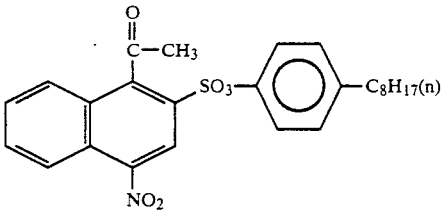
AP-5
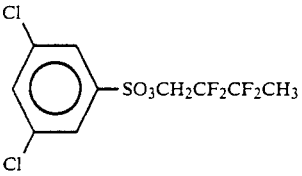
AP-6
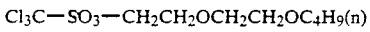
AP-7
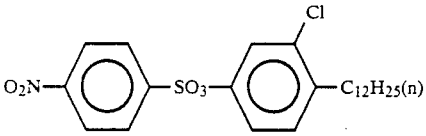
AP-8
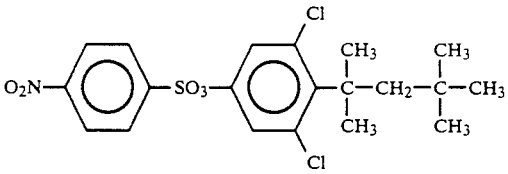
AP-9
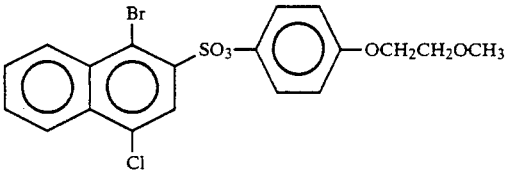
AP-10
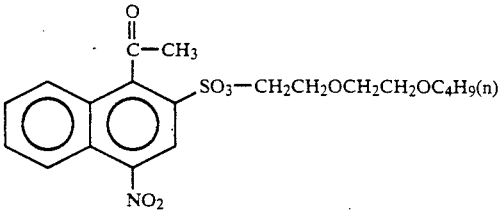
-continued
AP-11
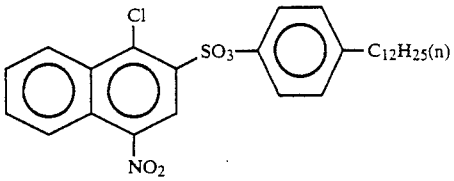
AP-12
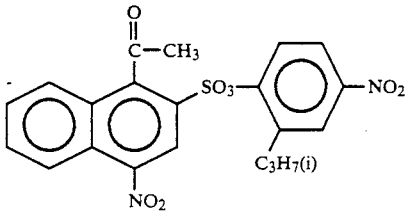
Specific examples of the compounds represented by formula (II) are provided below:
AP-13
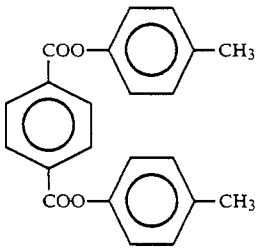
AP-14
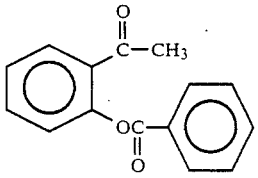
AP-15
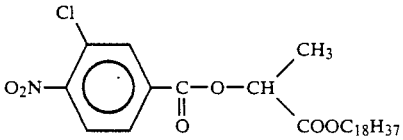
AP-16
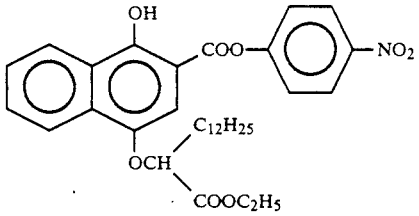
AP-17
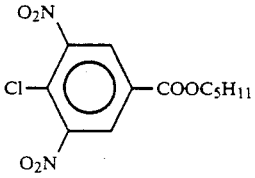
AP-18
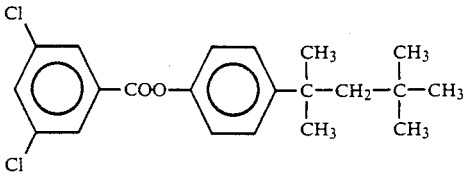

-continued

AP-19

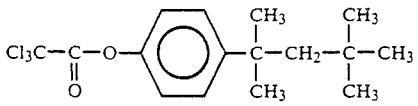

AP-20

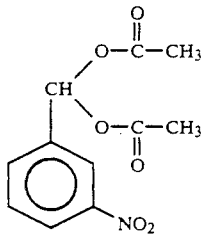

AP-21

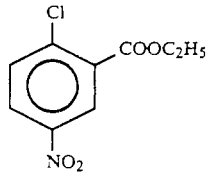

AP-22

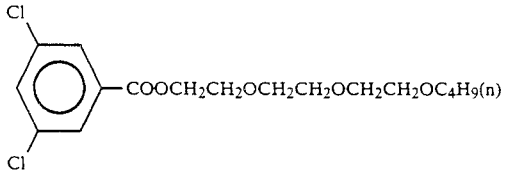

AP-23

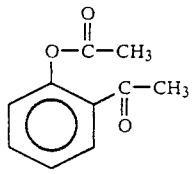

AP-24

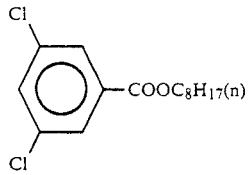

AP-25

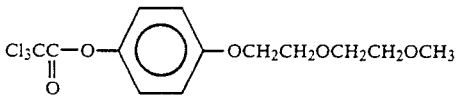

AP-26

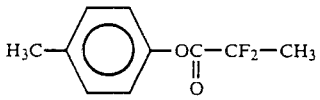

AP-27

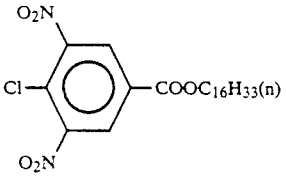

AP-28

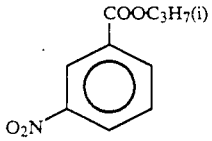

-continued

AP-29

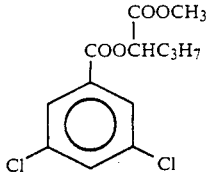

AP-30

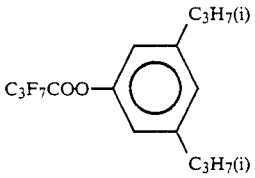

The sparingly soluble basic metal salt compound used in the present invention means a basic metal salt having a solubility in water of 0.5 or less at 25° C., wherein the solubility is defined as a gram number of the basic metal salt dissolved in 100 g of water. Examples of the metal salts include carbonates, phosphates, silicates, borates, aluminates, hydroxides, oxides and double salts thereof.

The above-described basic metal salt compounds are employed in the present invention as base generating agents such as utilized in the image forming reaction as described, for example, in JP-A-62-129848 and U.S. Pat. No. 4,740,445, or as pigments for improving discrimination of image as described in JP-A-61-20943.

Specific examples of the basic metal salt compounds used in the present invention are set forth below:

Calcium carbonate, barium carbonate, magnesium carbonate, zinc carbonate, strontium carbonate, calcium magnesium carbonate ($CaMg(CO_3)_2$), magnesium oxide, zinc oxide, tin oxide, cobalt oxide, zinc hydroxide, aluminium hydroxide, magnesium hydroxide, calcium hydroxide, antimony hydroxide, tin hydroxide, iron hydroxide, bismuth hydroxide, manganese hydroxide, calcium phosphate, magnesium phosphate, magnesium borate, calcium silicate, magnesium silicate, zinc aluminate, calcium aluminate, basic zinc carbonate ($2ZnCO_3.3Zn(OH)_2.H_2O$), basic magnesium carbonate ($3MgCO_3.Mg(OH)_2.3H_2O$), basic nickel carbonate ($NiCO_3.2Ni(OH)_2$), basic bismuth carbonate ($Bi_2(CO_3)O_2.H_2O$), basic cobalt carbonate ($2CoCO_3.3Co(OH)_2$), and magnesium aluminium oxide.

The amount of the sparingly water-soluble basic metal salt compound used can be varied over a wide range, but it is preferably in a range of 50% by weight or less, more preferably in a range from 0.01 to 40% by weight, based on a weight of the coating layer.

The sparingly water-soluble basic metal salt compound is advantageously incorporated into a layer of the light-sensitive material as a fine grain dispersion thereof prepared by the method as described, for example, in JP-A-56-174830 and JP-A-53-102733. An average grain size thereof is preferably 50 μm or less, particularly preferably 5 μm or less.

The basic metal salt compound can be added to any desired layer of the light-sensitive material such as a light-sensitive layer, an intermediate layer or a protective layer, other than a layer containing a developing agent. It also may be added to two or more layers thereof.

The heat-developable light-sensitive material according to the present invention comprises, in substance, a support having thereon a light-sensitive silver halide, a binder, a sparingly water-soluble basic metal salt compound and a dye providing compound. Further, the light-sensitive material may contain an organic metal salt oxidizing agent, and a reducing agent (as which a dye providing compound serves sometime as described hereinafter) if desired. These components are ordinarily added to the same layer in many cases, but may be separately added to different layers as far as they are capable of reacting with each other. For example, reduction in sensitivity can be prevented by incorporating the dye providing compound, which is colored, into a layer beneath the silver halide emulsion layer.

The reducing agent is preferably incorporated into the heat-developable light-sensitive material. However, it may be supplied from outside by an appropriate method, for example, by the diffusion from a dye fixing material as described hereinafter.

In order to obtain a wide range of color in a chromaticity diagram using the three primary colors of yellow, magenta and cyan, at least three silver halide emulsion layers each having sensitivity in a different spectral range are employed in combination. For example, a combination of a blue-sensitive layer, a green-sensitive layer and a red-sensitive layer and a combination of a green-sensitive layer, a red-sensitive layer and an infrared-sensitive layer are illustrative in this regard. These light-sensitive layers can be positioned according to various orders known for conventional type color light-sensitive materials. Further, each of these light-sensitive layers may be divided into two or more layers, if desired.

The heat-developable light-sensitive material may have various subsidiary layers, for example, a protective layer, a subbing layer, an intermediate layer, a yellow filter layer, an antihalation layer, or a back layer.

The silver halide which can be used in the present invention may be any one of silver chloride, silver bromide, silver iodobromide, silver chlorobromide, silver chloroiodide, and silver chloroiodobromide.

The silver halide emulsion to be used in the present invention can be either a surface latent image type silver halide emulsion or an internal latent image type silver halide emulsion. The internal latent image type emulsion is employed as a direct reversal emulsion by combination with a nucleating agent or light fogging. The silver halide emulsion to be used in the present invention may be a so-called core/shell emulsion in which the surface thereof differs from the interior thereof in phase.

The silver halide emulsion can be a monodisperse emulsion or a polydisperse emulsion. Also, a mixture of two or more monodisperse emulsions can be employed. A particle size of silver halide grains is preferably from 0.1 to 2 μm, particularly from 0.2 to 1.5 μm. The crystal habit of silver halide particles may be any of cubic, octahedral, tetradecahedral or high aspect ratio tabular grains.

Suitable examples of silver halide emulsion which can be used are described, for example, in U.S. Pat. Nos. 4,500,626 (50th column) and 4,628,021, *Research Disclosure*, No. 17029 (1978), and JP-A-62-253159.

The silver halide emulsion may be used unripened. However, it is normally chemically sensitized before use. The silver halide emulsion may be subjected to a sulfur sensitization process, a reduction sensitization process, and a noble metal sensitization process, singly or in combination as known for conventional type light-sensitive materials. These chemical sensitization processes may be effected in the presence of a nitrogen-containing heterocyclic compound as described in JP-A-62-253159.

In the present invention, the amount of light-sensitive silver halide to be coated is in the range from 1 mg/m$^2$ to 10 g/m$^2$ in terms of silver.

In the heat-developable light-sensitive material according to the present invention, an organic metal salt may be employed as an oxidizing agent together with light-sensitive silver halide. Among the organic metal salts, organic silver salts are particularly preferred.

Examples of organic compounds which can be used to form the above-described organic silver salt oxidizing agent include benzotriazoles, fatty acids and other compounds as described, for example, in U.S. Pat. No. 4,500,626 (52nd column to 53rd column). Other useful examples of such organic compounds include silver salts of carboxylic acids containing an alkynyl group such as silver phenylpropiolate as described in JP-A-60-113235 and acetylene silver as described in JP-A-61-249044. Two or more organic silver salts may be used in combination.

These organic silver salts may be used in an amount of from 0.01 to 10 mol, preferably from 0.01 to 1 mol, per mol of light-sensitive silver halide. The total amount of light-sensitive silver halide and organic silver salt to be coated is preferably in the range from 50 mg to 10 g/m$^2$ in terms of silver.

In the present invention, various antifogging agents or photographic stabilizers may be used. Examples of such antifogging agents or photographic stabilizers used include azoles and azaindenes as described in *Research Disclosure*, No. 17643, pages 24 and 25 (1978), carboxylic acids or phosphoric acids containing nitrogen as described in JP-A-59-168442, mercapto compounds and metal salts thereof as described in JP-A-59-111636, and acetylene compounds as described in JP-A-62-87957.

The silver halide to be used in the present invention may be spectrally sensitized with a methine dye or the like. Examples of such dyes used include cyanine dyes, merocyanine dyes, complex cyanine dyes, complex merocyanine dyes, halopolar cyanine dyes, hemicyanine dyes, styryl dyes and hemioxonol dyes.

Specific examples of such dyes include sensitizing dyes as described, for example, in U.S. Pat. No. 4,617,257, JP-A-59-180550, JP-A-60-140335, and *Research Disclosure*, No. 17029, pages 12 and 13 (1978).

These sensitizing dyes may be used singly or in combination. Such a combination of sensitizing dyes is often used particularly for the purpose of supersensitization.

Besides such a sensitizing dye, the emulsion may contain a dye which has no spectral sensitizing effect itself but exhibits a supersensitizing effect or a substance which does not substantially absorb visible light but exhibits supersensitizing effect as described in U.S. Pat. No. 3,615,641, and JP-A-63-23145.

The sensitizing dye may be added to the emulsion during, before or after chemical ripening. Alternatively, it may be before or after the formation of nuclei of the silver halide grains in accordance with U.S. Pat. Nos. 4,183,756 and 4,225,666.

The amount of the sensitizing dye added is normally in the range from about $10^{-8}$ to about $10^{-2}$ mol per mol of silver halide.

As binders of layers for constituting the light-sensitive material or dye fixing material, hydrophilic binders are preferably employed. Examples of such binders are described in JP-A-62-253159, pages 26 to 28 therein. More specifically, transparent or translucent hydrophilic binders are preferred. Suitable examples of such binders include natural substances such as proteins (for example, gelatin and gelatin derivatives) and polysaccharides (for example, cellulose derivatives, starch, gum arabic, dextran and pullulan), and synthetic polymer compounds (for example, polyvinyl alcohol, polyvinyl pyrrolidone and acrylamide polymers).

Further, other suitable binders include highly water absorptive polymers, that is, homopolymers of vinyl monomer containing —COOM or —$SO_3M$ (M represents a hydrogen atom or an alkali metal), or copolymers composed of two or more of such vinyl monomers or composed of such a vinyl monomer and another different vinyl monomer (for example, sodium methacrylate, ammonium methacrylate and Sumikagel L-5H manufactured by Sumitomo Chemical Co., Ltd.) as described, for example, in JP-A-62-245260.

Two or more of these binders may be employed in combination.

When a system of conducting heat development together with supplying a slight amount of water is adopted, it becomes possible to absorb water rapidly using the above-described highly water absorptive polymer. Further, re-transfer of dyes from a dye fixing material to other materials after dye transfer can be prevented by incorporating the highly water absorptive polymer into a dye fixing layer or a protective layer thereof.

In the present invention, the amount of the binder to be coated is preferably 20 g or less, more preferably 10 g or less, and most preferably 7 g or less, per square meter.

Various polymer latexes can be incorporated into layers constituting the light-sensitive material or dye fixing material (including a backing layer), for the purpose of improving physical properties of layers such as increasing dimensional stability and preventing curling, blocking, cracking, or pressure sensitization or desensitization. Specifically, any of the polymer latexes as described, for example, in JP-A-62-245258, JP-A-62-136648 and JP-A-62-110066 may be employed. In particular, the cracking of a mordanting layer can be prevented by using a polymer latex having a low glass transition point (40° C. or less) in the mordanting layer. The curling is effectively prevented by adding a polymer latex having a high glass transition point to the backing layer.

Reducing agents which can be used in the present invention include those known in the field of heat-developable light-sensitive materials. Also, dye providing compounds having reducing power as described hereinafter can be employed. In the latter case, other reducing agents may be used together with the dye providing compound having reducing power. Furthermore, the reducing agent can be used in the form of a reducing agent precursor which has no reducing power itself but which takes on reducing power when acted on by a nucleophilic reagent or heat during development.

Examples of reducing agents which can be used in the present invention include reducing agents and reducing agent precursors as described, for example, in U.S. Pat. Nos. 4,500,626 (49th column to 50th column), 4,483,914 (30th column to 31st column), 4,330,617 and 4,590,152, JP-A-60-140335 (pages 17 to 18), JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253 to JP-A-62-131256 and European Patent 220,746A2 (pages 78 to 96).

Combinations of various reducing agents as described in U.S. Pat, No. 3,039,869 also may be used in the practice of present invention.

In case of using a diffusion-resistant reducing agent as described hereinafter, an electron transfer agent and/or an electron transfer agent precursor may be employed in combination with the diffusion-resistant reducing agent, if desired, in order to accelerate electron transfer between the diffusion-resistant reducing agent and developable silver halide.

The electron transfer agent or precursor thereof to be used can be selected from the reducing agents or precursors thereof described above. The mobility of the electron transfer agent or precursor thereof is desirably larger than that of the diffusion-resistant reducing agent (electron donor). Particularly useful electron transfer agents are 1-phenyl-3-pyrazolidone or an aminophenol.

The diffusion-resistant reducing agents (electron donor) used in combination with an electron transfer agent are selected from the reducing agents described above which do not substantially move, that is, exhibit limited mobility, in a layer of the light-sensitive material. Preferred examples thereof include hydroquinones, sulfonamidophenols, sulfonamidonaphthols, compounds described as electron donors in JP-A-53-110827, and diffusion-resistant and reducing dye providing compounds as described hereinafter.

In the present invention, the amount of the reducing agent added is preferably from 0.001 to 20 mol, preferably from 0.01 to 10 mol, per mol of silver.

In the present invention, a dye providing compound, that is, a compound which forms or releases a mobile dye in correspondence or counter-correspondence to a reaction in which a silver ion is reduced to silver under a high temperature condition, is employed.

An example of the dye providing compound which can be used in the present invention is a compound which forms a dye upon an oxidative coupling reaction with an oxidation product of color developing agent (coupler). Such a coupler may be a four-equivalent coupler or a two-equivalent coupler. Two-equivalent couplers which have a diffusion-resistant group in the releasing group thereof and form a diffusible dye upon the oxidative coupling reaction are preferred. The diffusion resistant group may be in the form of a polymer chain. Specific examples of the color developing agents and couplers are described in detail, for example, in T. H. James, *The Theory of the Photographic Process*, Fourth Edition, pages 291 to 334 and 354 to 361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Another example of the dye providing compound is a compound which has a function of releasing or diffusing imagewise a diffusible dye. This type of a compound can be represented by formula (LI):

$$(D—Y)_n—Z \qquad \text{(LI)}$$

wherein D represents a dye moiety, a dye moiety which has been temporarily shifted to a shorter wavelength range or a dye precursor moiety. Y represents either a simple bond or a connecting group. Z represents a group which contributes a property to the compound represented by $(D—Y)_n—Z$ such that the diffusibility of the compound can be differentiated in correspondence or counter-correspondence to light-sensitive silver salts having a latent image distributed imagewise. Alternatively, Z represents a group having a property of releasing the moiety D from the compound in correspondence or counter-correspondence to light-sensitive silver salts having a latent image distributed imagewise. Further, the diffusibility of the moiety D as released is different from that of the compound represented by $(D—Y)_n—Z$. For purposes of the formula (LI), n represents 1 or 2, and when n is 2, two D—Y's may be used which may be the same or different.

Specific examples of the dye providing compound represented by formula (LI) include compounds classified in Groups (1) to (5) described below. Compounds in Groups (1) to (3) are those which form a diffusible dye image (positive dye image) in counter-correspondence to development of silver halide, and compounds in Groups (4) and (5) are those which form a diffusible dye image (negative dye image) in correspondence to development of silver halide.

Specific examples of the dye providing compound as represented by formula (LI) are as follows:

(1) A dye developer in which a hydroquinone type developing agent and a dye component are connected to each other as described, for example, in U.S. Pat. Nos. 3,134,764, 3,362,819, 3,597,200, 3,544,545 and 3,482,972. The dye developer is diffusible under an alkaline condition but becomes non-diffusible upon a reaction with silver halide.

(2) A non-diffusible compound which releases a diffusible dye under an alkaline condition but loses its function upon a reaction with silver halide as described, for example, U.S. Pat. No. 4,503,137. Specific examples thereof include a compound which undergoes an intramolecular nucleophilic displacement reaction to release a diffusible dye as described, for example, in U.S. Pat. No. 3,980,479, and a compound which undergoes an intramolecular rewind reaction of an isoxazolone ring to release a diffusible dye as described, for example, in U.S. Pat. No. 4,199,354.

(3) A non-diffusible compound which reacts with a reducing agent that has remained unoxidized upon development to release a diffusible dye as described, for example, in U.S. Pat. Nos. 4,559,290 and 4,783,396, European Patent 220,746A2 and *Kokaigiho*, 87-6199.

Specific examples thereof include a compound which undergoes an intramolecular nucleophilic displacement reaction after being reduced to release a diffusible dye as described, for example, in U.S. Pat. Nos. 4,139,389 and 4,139,379, JP-A-59-185333 and JP-A-57-84453, and a compound which undergoes an intramolecular electron transfer reaction after being reduced to release a diffusible dye as described, for example, in U.S. Pat. No. 4,232,107, JP-A-59-101649, JP-A-61-88257 and *Research Disclosure*, No. 24025 (April, 1984). Other examples include a compound which undergoes cleavage a single bond after being reduced to release a diffusible dye as described, for example, in West German Patent 3,008,588A, JP-A-56-142530 and U.S. Pat. No. 4,343,893 and 4,619,884; a nitro compound which release a diffusible dye after electron acceptance as described, for example, in U.S. Pat. No. 4,450,223; and a compound which releases a diffusible dye after electron acceptance as described, for example, in U.S. Pat. No. 4,609,610.

More highly preferred compounds include a compound which has both an N—X bond (wherein X represents an oxygen atom, a sulfur atom or a nitrogen atom) and an electron withdrawing group in the compound's molecule as described, for example, in European Patent 220,746A2, *Kokaigiho*, 87-6199, U.S. Pat. No. 4,783,396, JP-A-63-201653 and JP-A-63-201654, and a compound which has both an $SO_2$—X bond (wherein X has the same meaning as defined above) and an electron withdrawing group in its molecule as described, for example, in Japanese Patent Application No. 62-106885 (corresponding to JP-A-1-26842). Additional examples include a compound which has both a PO—X bond (wherein X has the same meaning as defined above) and an electron withdrawing group in its molecule as described, for example, in JP-A-63-271344, and a compound which has both a C—X' bond (wherein X' has the same meaning as X defined above or represents —$SO_2$—) and an electron withdrawing group as described in JP-A-63-271341. Further, another more highly preferred compound is a compound which undergoes cleavage a single bond by a $\pi$ bond conjugated with an electron accepting group after being reduced to release a diffusible dye as described, for example, in Japanese Patent Application Nos. 62-319989 and 62-320771 (corresponding to JP-A-1-161237 and JP-A-1-161342, respectively) is also employed.

Among the above-described more highly preferred compounds, compounds having both an N—X bond and an electron withdrawing group in their molecules are especially preferred. Specific examples thereof include Compounds (1) to (3), (7) to (10), (12), (13), (15), (23) to (26), (31), (32), (35), (36), (40), (41), (44), (53), to (59), (64) and (70) described in European Patent 220,746A2 (or U.S. Pat. No. 4,783,396) and Compounds (11) to (23) described in *Kokaigiho*, 87-6199.

(4) A compound which is a coupler having a diffusible dye in a releasing group and releases the diffusible dye upon a reaction with an oxidation product of a reducing agent (DDR coupler). Specific examples thereof include those as described in British Patent 1,330,524, JP-B-48-39165 (the term "JP-B" as used herein means an "examined Japanese patent publication") and U.S. Pat. Nos. 3,443,940, 4,474,867 and 4,483,914.

(5) A compound which is reductive to silver halide or an organic silver salt and undergoes the reduction thereof to release a diffusible dye (DRR compound). Such a type of compound is preferred since the compound needs no other reducing agent and thus does not cause any problem of stain of images due to an oxidation decomposition product of the reducing agent. Typical examples of such compounds are described, for example, in U.S. Pat. Nos. 3,928,312, 4,053,312, 4,055,428 and 4,336,322, JP-A-59-65839, JP-A-59-69839, JP-A-53-3819, JP-A-51-104343, *Research Disclosure*, No. 17465 (October, 1978), U.S. Pat. Nos. 3,725,062, 3,728,113 and 3,443,939, JP-A-58-116537, JP-A-57-179840 and U.S. Pat. No. 4,500,626.

Specific examples of DRR compound include compounds as described in U.S. Pat. No. 4,500,626 (22nd column to 44th column). Particularly preferred among the compounds described therein are Compounds (1) to (3), (10) to (13), (16) to (19), (28) to (30), (33) to (35), (38) to (40), and (42) to (64) described in the above cited U.S. Pat. No. 4,500,626. Other useful examples are compounds described in U.S. Pat. No. 4,639,408 (37th column to 39th column).

In addition, dye providing compounds may be employed other than the above-described couplers and the compounds represented by formula (LI). For example, other suitable dye-providing compounds include dye-silver compounds wherein an organic silver salt is connected with a dye as described, for example, in *Research Disclosure*, pages 54 to 58 (May, 1978); azo dyes used in a heat-developable silver dye bleaching process as described, for example, in U.S. Pat. No. 4,235,957 and *Research Disclosure*, pages 30 to 32 (April, 1976); and leuco dyes as described, for example, in U.S. Pat. Nos. 3,985,565 and 4,022,617.

Hydrophobic additives such as dye providing compounds and diffusion-resistant reducing agents can be incorporated into any of the layers of the light-sensitive material by any suitable conventional method such as described, for example, in U.S. Pat. No. 2,322,027. Where such hydrophobic additives are used, an organic solvent having a high boiling point as described, for example, JP-A-59-83154, JP-A-59-178451, JP-A-59-178452, JP-A-59-178453, JP-A-59-178454, JP-A-59-178455 and JP-A-59-178457 may be used optionally in combination with a low boiling organic solvent having a boiling point of 50° to 160° C.

The amount of such a high boiling organic solvent to be used is normally 10 g or less, preferably 5 g or less, per g of dye providing compound. Further, the amount of such high boiling organic solvent is normally 1 ml or less, more preferably 0.5 ml or less, and most preferably 0.3 ml or less, per g of binder.

A dispersing method using a polymer as described, for example, in JP-B-51-39853 and JP-A-51-59943, can be used to incorporate the hydrophobic additive into a layer of the light-sensitive material.

If the additive is a compound which is substantially water-insoluble, the additive may be incorporated into the binder in the form of a fine dispersion instead of using the above-described methods.

When a hydrophobic compound is dispersed in a hydrophilic colloid, various surface active agents can be used. Examples of such surface active agents which can be used in this process include those described as surface active agents in JP-A-59-157636, pages 37 and 38.

In the present invention, the light-sensitive material may contain a compound which serves to activate development as well as to stabilize images. Specific examples of such compounds which can be preferably used in the present invention are described in U.S. Pat. No. 4,500,626 (51st column to 52nd column).

In a system which employs diffusion transfer of dyes to form images, a dye fixing material is used together with a light-sensitive material. An embodiment in which a light-sensitive material and a dye fixing material are separately coated on two supports and an embodiment in which a light-sensitive material and a dye fixing material are coated on the same support can be employed.

For the relationship between the light-sensitive material and the dye fixing material, between the light-sensitive material and the support, and between the light-sensitive material and a white reflecting layer, the arrangements as described in U.S. Pat. No. 4,500,626 (57th column) can be applied to the present invention.

The dye fixing material which can be preferably used in the present invention comprises at least one layer containing a mordant and a binder. Mordants which can be used in the present invention include conventional mordants in the field of photography. Specific examples of such conventional mordants are described, for example, in U.S. Pat. No. 4,500,626 (58th column to 59th column), JP-A-61-88256 (pages 32 to 41), JP-A-62-244043 and JP-A-62-244036. Further, dye receptive polymer compounds, as described in U.S. Pat. No. 4,463,079, may be employed.

The dye fixing material may comprise a subsidiary layer, for example, a protective layer, a stripping layer and an anti-curling layer, if desired. The dye fixing material is especially effective to provide a protective layer.

Layers constituting the light-sensitive material and dye fixing material can incorporate plasticizers, slipping agents, and organic solvents having a high boiling point as improving agents for stripping property of the light-sensitive material and dye fixing material. Specific examples thereof are described, for example, in JP-A-62-253159 (page 25) and JP-A-62-245253.

Moreover, for the purpose of improving stripping property as described above, various silicone oils (any silicone oils including from dimethyl silicone oil to modified silicone oils obtained by introducing various organic groups to dimethylsiloxane) can be employed. Useful examples of the silicone oils are various modified silicone oils, particularly carboxy-modified silicone (trade name: X-22-3710) as described in *Modified Silicone Oil*, technical data, pages 6 to 18B published by Shin-Etsu Silicone Co. Further, silicone oils as described in JP-A-62-215953 and JP-A-63-46449 are also effective.

In the light-sensitive material and dye fixing material, color fading preventing agents may be employed. Color fading preventing agents which can be used include antioxidants, ultraviolet light absorbing agents and certain types of metal complexes.

Suitable examples of antioxidants include chroman series compounds, coumaran series compounds, phenol series compounds (for example, hindered phenols), hydroquinone derivatives, hindered amine derivatives and spiroindan series compounds. Further, compounds as described in JP-A-61-159644 are also effective.

Suitable examples of ultraviolet light absorbing agents include benzotriazole series compounds (those as described in U.S. Pat. No. 3,533,794), 4-thiazolidone series compounds (those as described in U.S. Pat. No. 3,352,681), benzophenone series compounds (those as described in JP-A-46-2784), and compounds as described in JP-A-54-48535, JP-A-62-136641 and JP-A-61-88256. Further, ultraviolet light-absorptive polymers as described in JP-A-62-260152 are effective.

Suitable examples of metal complexes include compounds as described, for example, in U.S. Pat. Nos. 4,241,155, 4,245,018 (3rd column to 36th column), and 4,254,195 (3rd column to 8th column), JP-A-62-174741, JP-A-61-88256 (pages 27 to 29), JP-A-63-199248 and Japanese Patent Application Nos. 62-234103 and 62-230595 (corresponding to JP-A-1-75568 and JP-A-1-74272, respectively).

Suitable examples of color fading preventing agents are described in JP-A-62-215272 (pages 125 to 137).

Color fading preventing agents, which are used for the purpose of preventing fading of transferred dyes in the dye fixing material, can be previously incorporated into the dye fixing material or may be supplied to the dye fixing material from an outside source, for example, from the light-sensitive material.

The above-described antioxidants, ultraviolet light absorbing agents and metal complexes may be used in combination with one another.

In the light-sensitive material and dye fixing material, there may be used brightening agents. It is particularly preferred to incorporate brightening agents into the dye fixing material or to supply them from an outside source, for example, from the light-sensitive material. Suitable examples of brightening agents are described, for example, in K. Veenkataraman, *The Chemistry of Synthetic Dyes*, Vol. V, Chapter 8, and JP-A-61-143752. More specifically, preferred brightening agents include stilbene series compounds, coumarin series compounds, biphenyl series compounds, benzoxazolyl series compounds, naphthalimide series compounds, pyrazoline series compounds and carbostyryl series compounds.

The brightening agents may be employed in combination with the color fading preventing agents.

Suitable examples of hardening agents which can be used in the layers constituting the light-sensitive material or dye fixing material include those as described, for example, in U.S. Pat. No. 4,678,739 (41st column), JP-A-59-116655, JP-A-62-245261 and JP-A-61-18942. More specifically, aldehyde series hardeners (for example, formaldehyde), aziridine series hardeners, epoxy series hardeners (for example,

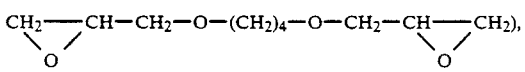

vinylsulfone series hardeners (for example, N,N'-ethylenebis(vinylsulfonylacetamido) ethane), N-methylol series hardeners (for example, dimethylolurea), and polymer hardeners (for example, compounds as described in JP-A-62-234157).

In the layers constituting the light-sensitive material and dye fixing material, various surface active agents are employed as coating aids or for other purposes, for example, improvement in stripping property, improvement in sliding property, antistatic property, and development acceleration. Specific examples of useful surface active agents are described, for example, in JP-A-62-173463 and JP-A-62-183457.

Layers constituting the light-sensitive material and dye fixing material may have organic fluoro compounds incorporated for the purpose of improvement in sliding property, antistatic property, and improvement in stripping property. Typical examples of the organic fluoro compounds include fluorine series surface active agents as described, for example, in JP-B-57-9053 (8th column to 17th column), JP-A-61-20944 and JP-A-62-135826, oily fluorine series compounds such as fluoro oil, and hydrophobic fluorine compounds such as solid fluoro resin compounds, for example, tetrafluoroethylene resin.

Matting agents can be used in the light-sensitive material and dye fixing material. Suitable examples of matting agents include silicon dioxide, compounds such as polyolefin and polymethacrylates as described in JP-A-61-88256 (page 29), as well as compounds such as benzoguanamine resin beads, polycarbonate resin beads and polystyrene resin beads as described in Japanese Patent Application Nos. 62-110064 and 62-110065 (corresponding to JP-A-63-274944 and JP-A-63-63-274952, respectively).

Furthermore, the layers constituting the light-sensitive material and dye fixing material may incorporate other additives, for example, thermal solvents, defoaming agents, sterilizers, antimolds, and colloidal silica. Specific examples of these additives are described in JP-A-61-88256 (pages 26 to 32).

In the light-sensitive material and/or dye fixing material according to the present invention, image formation accelerating agents can be employed. Such image formation accelerating agents can serve to accelerate numerous reactions and processes including an oxidation reduction reaction of a silver salt oxidizing agent with a reducing agent, as well as a reaction such as formation or decomposition of a dye or release of a diffusible dye from a dye providing compound, and also a migration of a dye from a light-sensitive material layer to a dye fixing layer. In the light of physicochemical function, image formation accelerating agents can be classified into bases or base precursors, nucleophilic compounds, organic solvents having a high boiling point (oils), thermal solvents, surface active agents, and compounds capable of interacting with silver or silver ion. However, each of these substance groups generally has a composite function and thus promotes a combination of the above-described accelerating effects. The details thereof are described, for example, in U.S. Pat. No. 4,678,739 (38th column to 40th column).

Examples of useful base precursors include salts of organic acids and bases which decompose by heating with decarboxylation, and also compounds which release an amine upon decomposition with an intramolecular nucleophilic displacement reaction, a Lossen rearrangement reaction or a Beckmann rearrangement reaction. Specific examples thereof are described, for example, in U.S. Pat. No. 4,511,493 and JP-A-62-65038.

In a system wherein heat development and transfer of dye are simultaneously conducted in the presence of a small amount of water, it is preferred to incorporate a base and/or a base precursor into the dye fixing material from the standpoint of increasing preservability of the light-sensitive material.

In addition, the sparingly water-soluble basic metal salt compound according to the present invention can be employed as a base precursor. In such a case, combinations of sparingly soluble metal compounds and compounds (referred to as complex forming compounds) capable of forming a complex with a metal ion constituting the sparingly soluble metal compound as described in EP-A-210660 and U.S. Pat. No. 4,740,445 are employed. Furthermore, compounds which generate a base upon electrolysis as described in JP-A-61-232451 can be employed as base precursors. Particularly, the former method employing the above-described combinations is especially effective. It is advantageous that the sparingly soluble metal compound and the complex forming compound are added separately to the light-sensitive material and the dye fixing material.

In the light-sensitive material and/or dye fixing material according to the present invention, various development stopping agents can be used for the purpose of ensuring constant image quality regardless of any fluctuation in processing temperature and time during development.

The term "development stopping agent" as used herein means a compound which rapidly neutralizes or reacts with a base to decrease the base concentration in the layer so that development is stopped after proper development, or, alternatively, a compound which interacts with silver or silver salt to inhibit development after proper development. Specific examples of such development stopping agents include acid precursors which release an acid upon heating, electrophilic compounds which undergo a displacement reaction with a base present therewith upon heating, and nitrogen-containing heterocyclic compounds, mercapto compounds and precursors thereof. More specifically, development stopping agents described, for example, in JP-A-62-253159 (pages 31 and 32) can be employed.

Supports used in the light-sensitive material and dye fixing material according to the present invention are those which can endure the processing temperature. In general, paper and synthetic polymer films are employed. More specifically, films of polyethylene terephthalate, polycarbonate, polyvinyl chloride, polystyrene, polypropylene, polyimide and celluloses (for example, triacetyl cellulose) or those films containing pigment such as titanium oxide, synthetic paper produced from polypropylene, paper manufactured from a mixture of synthetic pulp such as polyethylene and natural pulp, Yankee paper, baryta paper, coated paper (particularly cast coated paper), metals, cloths, and glass are employed. These films may be employed individually, or as supports in which one or both surfaces of the film have been laminated with synthetic polymers such as polyethylene. Further, supports as described, for example, in JP-A-62-253159 (pages 29 to 31) are suitable.

The surface of the support may be coated with a mixture of a hydrophilic binder and a semiconductive metal oxide such as alumina sol and tin oxide, and an antistatic agent such as carbon black.

In order to expose images for recording on the light-sensitive material, various methods can be utilized including, for example, a method of direct photographing a landscape or portrait using a camera, or a method of exposure through a reversal film or a negative film by means of a printer or an enlarger, or a method of scanning exposure of an original through a slit using an exposure device of a copying machine, or a method wherein image information is exposed upon light emission from a light emitting diode or various laser via electric signal, or a method wherein image information on an image display device, for example, CRT, liquid crystal display, electroluminescence display, or plasma display is exposed directly or through an optical system.

Light sources for recording images on the light-sensitive material which can be used include those as described, for example, in U.S. Pat. No. 4,500,626 (56th column) such as natural light, tungsten lamps, light emitting diodes, laser light sources, and CRT (cathode ray tube) light sources, as described above.

Furthermore, image exposure may be conducted using a wavelength conversion element composed of a combination of a nonlinear optical material and a coherent light source such as laser light. The nonlinear optical material is a material capable of generating nonlinearity between electric field and polarization which occurs when strong photoelectric field such as laser light is provided. Specific examples of the nonlinear optical materials which can be preferably used include inorganic compounds represented by, for example, lithium niobate, potassium dihydrogenphosphate (KDP), lithium iodate, or $BaB_2O_4$, urea derivatives, nitroaniline derivatives, nitropyridine-N-oxide derivatives such as 3-methyl-4-nitropyridine-N-oxide (POM), or compounds as described, for example, in JP-A-61-53462 and JP-A-62-210432. As the form of the wavelength conversion element, a single crystal light conducting wave guide type and a fiber type are conventional and are effectively employed in the practice of the present invention.

Moreover, the above-described image informations include image signals obtained by a video camera or an electro still camera, television signals representatively illustrated by Nippon Television Signal Code (NTSC), image signals obtained by dividing an original into many dots by means of a scanner, and image signals prepared by means of a computer representatively illustrated by CG and CAD.

The light-sensitive material and/or dye fixing material may have an electroconductive heat-generating layer (heating element) provided as a heating means for heat development or diffusion transfer of dyes. As the heating element, which is transparent or opaque in this situation, those described, for example, in JP-A-61-145544 are suitable. Additionally, the electroconductive layer acts also as an antistatic layer.

The heating temperature required for the heat development step is ordinarily in the range from about 50° C. to about 250° C., and preferably from about 80° C. to about 180° C. The diffusion transfer step of the dyes can be performed simultaneously with or after the heat development step. In the latter situation, the transfer can be conducted at a temperature ranging from the heat development temperature to room temperature, and particularly preferred is a temperature ranging from 50° C. to about 10° C. lower than the temperature at the heat development step.

The migration of dyes may occur only by heating, but an appropriate solvent may be employed in order to accelerate the transfer of dyes. Further, as described in detail, for example, in JP-A-59-218443 and JP-A-61-238056, a useful process is disclosed in which a light-sensitive material is heated in the presence of a small amount of solvent, particularly water, so that development and transfer are simultaneously or sequentially effected. In such a process, the heating temperature is preferably in the range from 50° C. to not higher than the boiling point of the solvent used. For example, if the solvent is water, the suitable heating temperature is in the range from 50° C. to 100° C.

Examples of such a solvent which can be used to accelerate development and/or migration of diffusible dyes to the dye fixing layer include water, and a basic aqueous solution containing an inorganic alkali metal salt or an organic base as above-described with reference to the image formation accelerator. Other suitable solvents include a solvent having a low boiling point, or a mixture of a solvent having a low boiling point and water or a basic aqueous solution. A surface active agent, an antifogging agent, or a sparingly soluble metallic salt and a complex forming compound may be optionally contained in the above-described solvents.

These solvents may be imparted to either or both of the dye fixing material and the light-sensitive material. The amount of the solvent to be used may be as small as less than the weight of the solvent of a volume equivalent to the maximum swelling volume of the entire coated film. In particular, the amount of solvent used is not more than the value obtained by subtracting the weight of the entire coated film from the weight of the solvent of a volume equivalent to the maximum swelling volume of the entire coated film.

Suitable methods for adding such a solvent to the light-sensitive layer or the dye fixing layer include those described, for example, in JP-A-61-147244 (page 26). Alternatively, the solvent may be previously incorporated into either the light-sensitive material or the dye fixing material or both of them in the form of microcapsule.

Furthermore, a system may be used in which a hydrophilic thermal solvent which remains in solid form at normal temperature, but melts at an elevated temperature, is incorporated in the light-sensitive material or the dye fixing material in order to accelerate the migration of dyes. Such a hydrophilic thermal solvent may be incorporated in either or both of the light-sensitive material and the dye fixing material. The layer in which the hydrophilic thermal solvent is to be incorporated can be any of the emulsion layer, an intermediate layer, a protective layer, and a dye fixing layer. The dye fixing layer and/or an adjacent layer are particularly useful in this regard.

Examples of the hydrophilic thermal solvent include ureas, pyridines, amides, sulfonamides, imides, alcohols, oximes, and other heterocyclic compounds.

Moreover, in order to accelerate the migration of dyes, an organic solvent having a high boiling point may be incorporated into the light-sensitive material and/or the dye fixing material.

Suitable heating methods for the above-described development step and/or transfer step include contact of the light-sensitive material and/or dye fixing material with a heated block or plate, a hot plate, a hot presser, a hot roller, or exposure to a halogen lamp heater, or an infrared or far infrared lamp heater, or passage through a high temperature atmosphere.

The pressure condition and pressure application process to be used when the light-sensitive material and the dye fixing material are brought into close contact with each other are described, for example, in JP-A-61-147244 (page 27).

Processing of the heat-developable light-sensitive materials according to the present invention can be carried out by means of any of various heat development machines. Preferably used heat development machines include those described, for example, in JP-A-59-75247, JP-A-59-177547, JP-A-59-181353, JP-A-60-18951 and JP-A-U-62-25944 (the term "JP-A-U" as used herein means an "unexamined published Japanese utility model application").

The present invention will be explained in greater detail with reference to the following examples, but the present invention should not be construed as being limited thereto.

EXAMPLE 1

A method for preparation of Emulsion (I) for the hereinafter described fifth layer is described below.

Solutions (I) and (II) described below were simultaneously added to an aqueous solution of gelatin, which had been prepared by dissolving 20 g of gelatin, 3 g of potassium bromide and 0.3 g of $HO(CH_2)_2S(CH_2)_2S—(CH_2)_2OH$ in 800 ml of water and maintained at a temperature of 55° C., over a period of 30 minutes while the aqueous solution of gelatin was being stirred vigorously. Thereafter, Solutions (III) and (IV) were added thereto simultaneously over a period of 20 minutes. Five minutes after the addition of Solutions (III) and (IV) had begun, Solution of Dye described below was added thereto over a period of 18 minutes.

After the emulsion was washed with water and desalted, 20 g of lime-processed ossein gelatin was added to the emulsion, and pH and pAg thereof were adjusted to 6.2 and 8.5, respectively. The emulsion was subjected to optimum chemical sensitization with sodium thiosulfate, 4-hydroxy-6-methyl-1,3,3a,7-tetraazaindene and chloroauric acid. Thereby, 600 g of a monodisperse tetradecahedral silver iodobromide emulsion having an average particle size of 0.40 μm was obtained.

Specific descriptions of the above-mentioned Solutions (I) to (IV), and Solution of Dye are provided below.

| | Solution (I) | Solution (II) | Solution (III) | Solution (IV) |
|---|---|---|---|---|
| $AgNO_3$ | 30 g | — | 70 g | — |
| KBr | — | 20 g | — | 49 g |
| KI | — | 1.8 g | — | — |
| | Water to make 180 ml | Water to make 180 ml | Water to make 350 ml | Water to make 350 ml |

Solution of Dye

A solution prepared by dissolving 0.12 g of the following dye

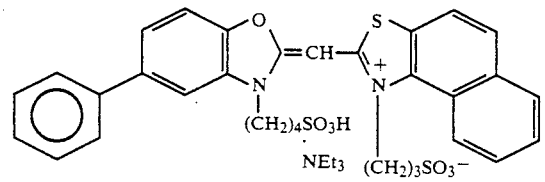

and 0.12 g of the following dye

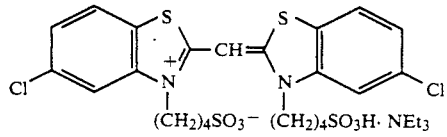

in 160 ml of methanol.

A method for preparation of Emulsion (II) for the hereinafter described third layer is described below.

Solution (I') and Solution (II') described below were simultaneously added to an aqueous solution of gelatin, which had been prepared by dissolving 20 g of gelatin, 0.30 g of potassium bromide, 6 g of sodium chloride and 0.015 g of Reagent A described below in 730 ml of water and maintained at a temperature of 60.0° C., at the same addition rate over a period of 60 minutes while the aqueous solution of gelatin was being stirred vigorously. After the completion of the addition of Solution (I') and Solution (II'), Solution (III'), which was a methanol solution of Sensitizing Dye (c) as described below, was added thereto. Thus, a monodisperse cubic silver chlorobromide emulsion adsorbed with dye having an average particle size of 0.45 μm was prepared.

After the emulsion was washed with water and desalted, 20 g of gelatin was added to the emulsion, and pH and pAg thereof were adjusted to 6.4 and 7.8, respectively. Then, the emulsion was subjected to chemical sensitization at 60.0° C. The reagents employed therefor were 1.6 mg of triethylthiourea and 100 mg of 4-hydroxy-6-methyl-1,3,3a,7-tetraazaindene and the time for ripening was 55 minutes. The yield of the emulsion was 635 g.

Specific descriptions of the above-mentioned Reagent A, Solutions (I') to (III'), and Sensitizing Dye (c) are provided below.

Reagent A

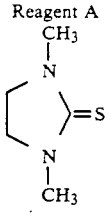

Sensitizing Dye (c)

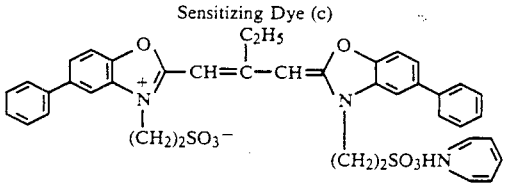

| | Solution (I') | Solution (II') | Solution (III') |
|---|---|---|---|
| $AgNO_3$ | 100.0 g | — | — |
| KBr | — | 56.0 g | — |
| NaCl | — | 7.2 g | — |
| Sensitizing Dye (c) | — | — | 0.23 g |
| | Water to make 400 ml | Water to make 400 ml | Methanol to make 77 ml |

A method for preparation of Emulsion (III) for the hereinafter described first layer is described below.

Solutions (I''), (II'') and (III'') described below were simultaneously added to an aqueous solution of gelatin, which had been prepared by dissolving 20 g of gelatin, 1 g of potassium bromide and 0.5 g of $HO(CH_2)_2S(CH_2)_2OH$ in 800 ml of water and maintained at a temperature of 50° C., at the same addition rate over a period of 30 minutes while the aqueous solution of gelatin was being stirred vigorously. Thus, a monodisperse silver bromide emulsion adsorbed with dyes having an average particle size of 0.42 μm was prepared.

After the emulsion was washed with water and desalted, 20 g of lime-processed ossein gelatin was added to the emulsion, and pH and pAg thereof were adjusted to 6.4 and 8.2, respectively. Then, the emulsion was subjected to chemical sensitization while maintaining at 60° C. for 45 minutes with 9 mg of sodium thiosulfate, 6 ml of a 0.01% aqueous solution of chloroauric acid and 190 ml of 4-hydroxy-6-methyl-1,3,3a,7-tetraazaindene. The yield of the emulsion was 635 g.

Specific descriptions of the above-mentioned Solutions (I'') to (III'') are provided below.

| | Solution (I'') | Solution (II'') | Solution (III'') |
|---|---|---|---|
| $AgNO_3$ | 100 g | — | — |
| KBr | — | 70 g | — |
| Dye (a) | — | — | 40 mg |
| Dye (b) | — | — | 80 mg |
| | Water to make 450 ml | Water to make 400 ml | Methanol to make 60 ml |

Dye (a)

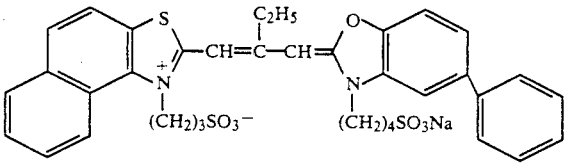

-continued

| | Solution (I'') | Solution (II'') | Solution (III'') |
|---|---|---|---|

Dye (b)

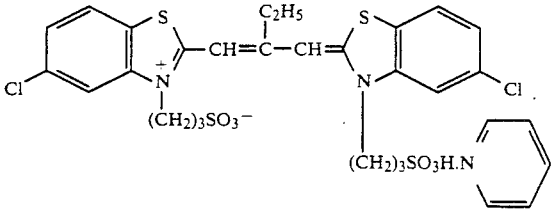

A method for preparation of a dispersion of zinc hydroxide is described below.

A mixture of 12.5 g of zinc hydroxide having an average particle size of 0.2 μm, 1 g of carboxymethyl cellulose and 0.1 g of sodium polyacrylate as dispersing agents, and 100 ml of a 4% aqueous solution of gelatin was ground in a mill using glass beads having an average particle size of 0.75 mm for 30 minutes. Then, after separating out the glass beads, a dispersion of zinc hydroxide was obtained.

A method for preparation of a dispersion of active carbon is described below.

A mixture of 2.5 g of active carbon powder (special grade reagent manufactured by Wakojunyaku Co.), 1 g of Demol N (manufactured by Kao Sekken Co.) and 0.25 g of polyethylene glycol nonylphenyl ether as dispersing agents, and 100 ml of a 5% aqueous solution of gelatin was ground in a mill using glass beads having an average particle size of 0.75 mm for 120 minutes. Then, after separating out the glass beads, a dispersion of active carbon having an average particle size of 0.5 μm was obtained.

A method for preparation of a dispersion of an electron transfer agent is described below.

A mixture of 10 g of the electron transfer agent described below, 0.5 g of polyethylene glycol nonylphenyl ether and 0.5 g of the anionic surface active agent described below as dispersing agents, and 100 ml of a 5% aqueous solution of gelatin was ground in a mill using glass beads having an average particle size of 0.75 mm for 60 minutes. Then, after separating out the glass beads, a dispersion of electron transfer agent having an average particle size of 0.3 μm was obtained.

Electron Transfer Agent:

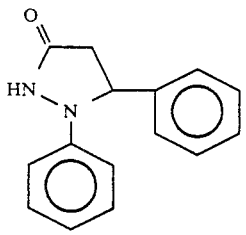

Anionic Surface Active Agent:

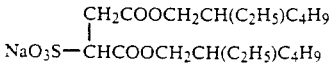

A method for preparation of a gelatin dispersion of dye providing compound is described below.

50 ml of ethyl acetate was added to each respective yellow, magenta and cyan composition described below and the mixture was heated at about 60° C. to form a uniform solution. The resulting solution was mixed while stirring with 100 g of a 10% aqueous solution of lime-processed gelatin, 0.6 g of sodium dodecylbenzenesulfonate and 50 ml of water, and the mixture was then dispersed by means of a homogenizer at 10,000 rpm for 10 minutes. The dispersion thus obtained was designated a gelatin dispersion of dye providing compound.

| | Yellow | Magenta | Cyan |
|---|---|---|---|
| Dye Providing Compound | (1): 13 g | (2): 15.5 g | (3): 16.6 g |
| Electron Donor (1) | 10.2 g | 8.6 g | 8.1 g |
| High Boiling Solvent (2) | 6.5 g | 7.8 g | 8.3 g |
| Electron Transfer Agent Precursor (3) | 0.4 g | 0.7 g | 0.7 g |

Dye Providing Compound (1)

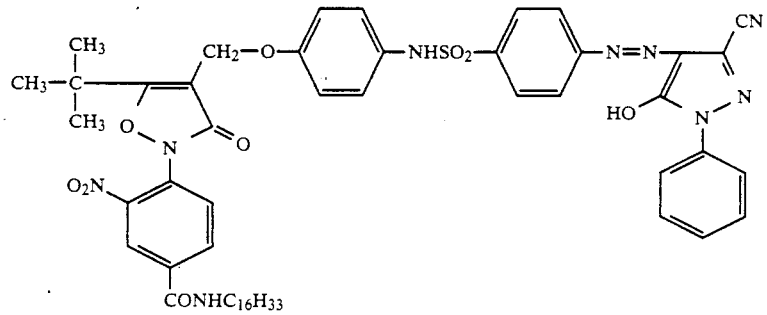

Dye Providing Compound (2)

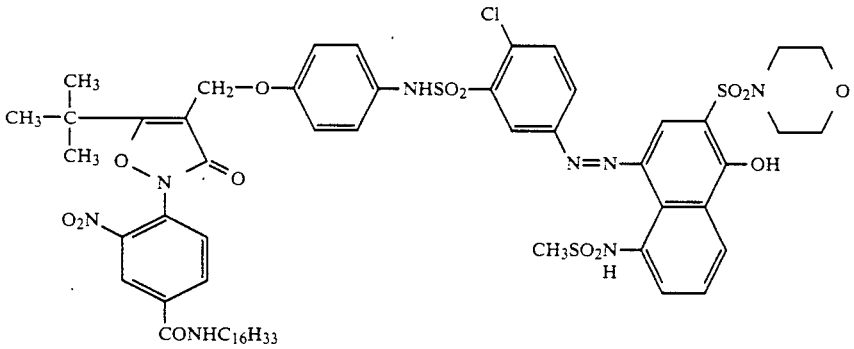

Dye Providing Compound (3)

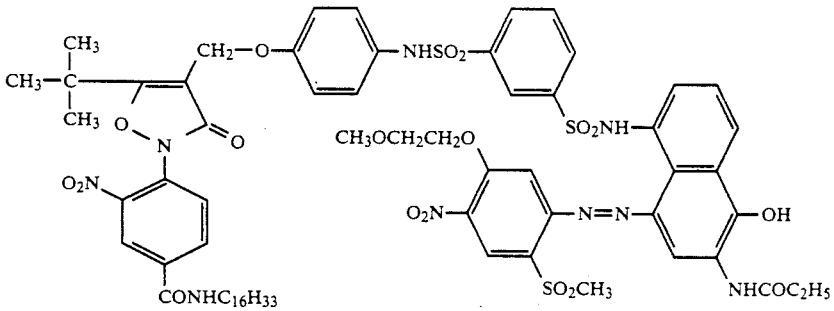

Electron Donor (1)

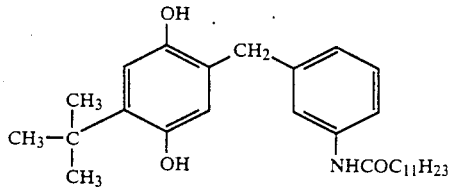

High Boiling Solvent (2)

-continued

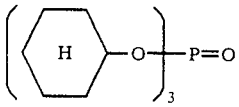

Electron Transfer Agent Precursor (3)

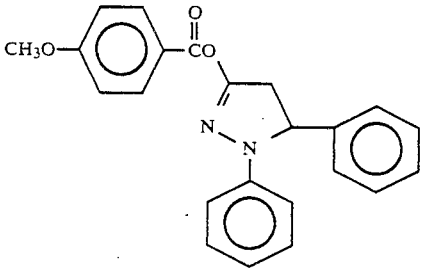

A method for preparation of a gelatin dispersion of Electron Donor (4) hereinafter described for the intermediate layer hereinafter described is described below.

23.6 g of Electron Donor (4) described below and 8.5 g of High Boiling Solvent (2) described above were added to 30 ml of ethyl acetate to form a uniform solution. The resulting solution was mixed while stirring with 100 g of a 10% aqueous solution of lime-processed gelatin, 0.25 g of sodium hydrogen sulfite, 0.3 g of sodium dodecylbenzenesulfonate and 30 ml of water, and the mixture was then dispersed by means of a homogenizer at 10,000 rpm for 10 minutes. The dispersion thus obtained was designated a gelatin dispersion of Electron Donor (4).

Electron Donor (4)

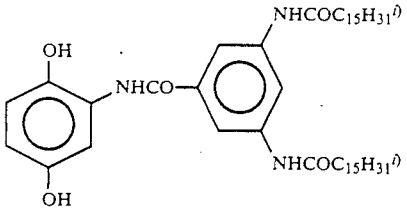

Using the components described above, a multilayer heat-developable color light-sensitive material (Light-Sensitive Material 101) shown in Table 1 below was prepared. In following Table 1, the coating amount of each component is set forth in parentheses.

TABLE 1

Construction of Light-Sensitive Material 101

Sixth Layer: Protective Layer

Gelatin (900 mg/m$^2$), Silica (size: 4 μm) (40 mg/m$^2$), Zinc hydroxide (600 mg/m$^2$), Surface active agent (5)*1 (130 mg/m$^2$), Surface active agent (6)*2 (26 mg/m$^2$), Water-soluble polymer*3 (8 mg/m$^2$)

Fifth Layer: Blue-Sensitive Emulsion Layer

Light-sensitive silver halide Emulsion (I) (380 mg/m$^2$ as silver), Yellow dye providing compound (1) (400 mg/m$^2$), Gelatin (600 mg/m$^2$), Electron donor (1) (308 mg/m$^2$), High boiling solvent (2) (200 mg/m$^2$), Electron transfer agent precursor (3) (15 mg/m$^2$), Zinc hydroxide (330 mg/m$^2$), Antifogging agent (12)*4 (0.6 mg/m$^2$), Surface active agent (7)*5 (18 mg/m$^2$), Water-soluble polymer*3 (13 mg/m$^2$)

Fourth Layer: Intermediate Layer

Gelatin (700 mg/m$^2$), Electron donor (4) (130 mg/m$^2$), High boiling solvent (2) (48 mg/m$^2$), Surface active agent (6)*2 (15 mg/m$^2$), Surface active agent (8)*6 (61 mg/m$^2$), Surface active agent (7)*5 (2 mg/m$^2$), Electron transfer agent (9)*7 (54 mg/m$^2$), Water-soluble polymer*3 (19 mg/m$^2$), Hardening agent (10)*8 (37 mg/m$^2$)

Third Layer: Green-Sensitive Emulsion Layer

Light-sensitive silver halide Emulsion (II) (220 mg/m$^2$ as silver), Magenta dye providing compound (2) (365 mg/m$^2$), Gelatin (310 mg/m$^2$), Electron donor (1) (158 mg/m$^2$), High boiling solvent (2) (183 mg/m$^2$), Electron transfer agent precursor (3) (15 mg/m$^2$), Electron transfer agent (9)*7 (27 mg/m$^2$), Surface active agent (7)*5 (13 mg/m$^2$), Water-soluble polymer*3 (11 mg/m$^2$), Antifogging agent (12)*4 (0.8 mg/m$^2$)

Second Layer: Intermediate Layer

Gelatin (790 mg/m$^2$), Zinc hydroxide (300 mg/m$^2$), Electron donor (4) (130 mg/m$^2$), High boiling solvent (2) (73 mg/m$^2$), Surface active agent (7)*5 (2 mg/m$^2$), Surface active agent (8)*6 (100 mg/m$^2$), Surface active agent (6)*2 (11 mg/m$^2$), Water-soluble polymer*3 (12 mg/m$^2$), Active carbon (25 mg/m$^2$)

First Layer: Red-Sensitive Emulsion Layer

Light-sensitive silver halide Emulsion (III) (230 mg/m$^2$ as silver), Cyan dye providing compound (3) (343 mg/m$^2$), Gelatin (330 mg/m$^2$), Electron donor (1) (163 mg/m$^2$), High boiling solvent (2) (172 mg/m$^2$), Electron transfer agent precursor (3) (17 mg/m$^2$), Electron transfer agent (9)*7 (28 mg/m$^2$), Surface active agent (7)*5 (10 mg/m$^2$), Water-soluble polymer*3 (5 mg/m$^2$), Antifogging agent (11)*10 (0.7 mg/m$^2$)

Support:

Polyethylene terephthalate film (thickness: 96 μm) having a carbon black coating as a back layer.

The additives shown in Table 1 above other than those described hereinbefore are illustrated and described below.

Surface active agent (5)

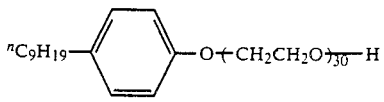

*1

-continued

Surface active agent (6)

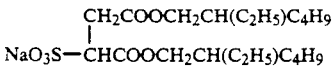

Water-soluble polymer

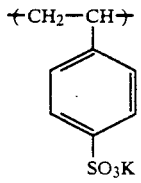

Antifogging agent (12)

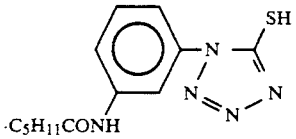

Surface active agent (7)

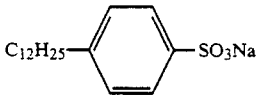

Surface active agent (8)

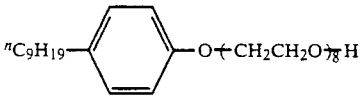

Electron Transfer Agent (9)

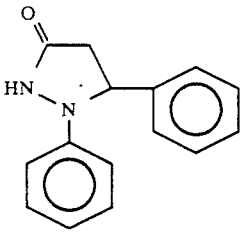

Hardening agent (10)

1,2-Bis(vinylsulfonylacetamido)ethane

Antifogging agent (11)

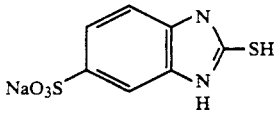

A method for preparation of a dye fixing material is described below.

Dye Fixing Material R-1 was prepared having the compositions shown in Table 2 below. In following Table 2, the coating amount of each component is set forth in parentheses.

TABLE 2

Third Layer:

Gelatin (0.05 g/m$^2$), Silicone oil (1) (0.04 g/m$^2$), Surface active agent (1) (0.001 g/m$^2$), Surface active agent (2) (0.02 g/m$^2$), Surface active agent (3) (0.10 g/m$^2$), Matting agent (1) (0.02 g/m$^2$), Guanidine picorate (0.45 g/m$^2$), Water-soluble polymer (1) (0.24 g/m$^2$)

Second Layer:

Mordant (1) (2.35 g/m$^2$), Water-soluble polymer (1) (0.20 g/m$^2$), Gelatin (1.40 g/m$^2$), Water-soluble polymer (2) (0.60 g/m$^2$), High boiling solvent (1) (1.40 g/m$^2$), Guanidine picorate (2.25 g/m$^2$), Brightening agent (1) (0.05 g/m$^2$), Surface active agent (5) (0.15 g/m$^2$)

First Layer:

Gelatin (0.45 g/m$^2$), Surface active agent (3) (0.01 g/m$^2$), Water-soluble polymer (1) (0.04 g/m$^2$), Hardening agent (1) (0.30 g/m$^2$)

Support:

Construction shown below

First Backing Layer:

Gelatin (3.25 g/m$^2$), Hardening agent (1) (0.25 g/m$^2$)

Second Backing Layer:

Gelatin (0.44 g/m$^2$), Silicone oil (1) (0.08 g/m$^2$), Surface active agent (4) (0.04 g/m$^2$), Surface active agent (5) (0.01 g/m$^2$), Matting agent (2) (0.03 g/m$^2$)

Construction of Support

| Layer | Composition | | Layer Thickness (μm) |
|---|---|---|---|
| Surface Subbing Layer | Gelatin | | 0.1 |
| Surface PE Layer (glossy) | Low-density polyethylene (density: 0.923) | 89.2 parts | 45.0 |
| | Titanium oxide treated its surface | 10.0 parts | |
| | Ultramarine | 0.8 part | |
| Pulp Layer | High-quality paper (LBKP:NBKP = 1:1, density: 1.080) | | 92.6 |
| Surface PE Layer (mat) | High-density polyethylene (density: 0.960) | | 36.0 |
| Surface Subbing Layer | Gelatin | | 0.05 |
| | Colloidal silica | | 0.05 |
| | | Total | 173.8 |

The additives shown in Table 2 above are illustrated and described below.

Silicone oil (1)

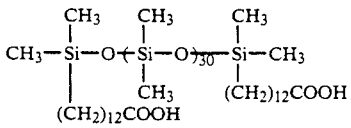

Surface active agent (1)

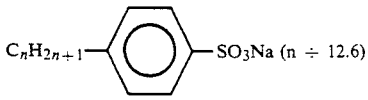

Surface active agent (2)

-continued $C_8F_{17}SO_2N(C_3H_7)CH_2COOK$

Surface active agent (3)

$C_{11}H_{23}CONHCH_2CH_2CH_2N^{\oplus}(CH_3)_2CH_2COO^{\ominus}$

Surface active agent (4)

$NaO_3S-CH(CH_2COOCH_2CH(C_2H_5)C_4H_9)COOCH_2CH(C_2H_5)C_4H_9$

Brightening agent (1)

2,5-Bis(5-tert-butylbenzoxazolyl-(2))thiophen

Surface active agent (5)

$C_8F_{17}SO_2N(C_3H_7)-(CH_2CH_2O)_4-(CH_2)_4SO_4Na$

Water-soluble polymer (1)

Sumikagel L5-H manufactured by Sumitomo Chemical Co., Ltd.

Water-soluble polymer (2)

Dextran (molecular weight: 70,000)

Mordant (1)

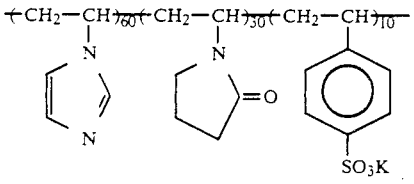

-continued

High boiling solvent (1)

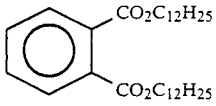

Hardening agent (1)

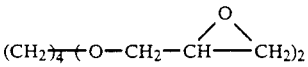

Matting agent (1)

Silica

Matting agent (2)

Benzoguanamine resin (average particle size: 15 μm)

Light-Sensitive Materials 102 to 112 in Table 3 below were prepared in the same manner as described for Light-Sensitive Material 101 above, except for adding the acid precursors according to the present invention and the comparative compounds as shown in Table 3 below, respectively. The acid precursor was added to the first, third and fifth layers using co-emulsification with a dye providing compound described above, and to the second and fourth layers using a co-emulsification with Electron donor (4) described above in the case of the emulsified dispersion method. On the other hand, the acid precursor was added by dispersing it in the same manner as described for Electron transfer agent (9) described above, when the fine particle dispersion method was applied.

TABLE 3

| Light-Sensitive Material | Acid Precursor or Comparative Compound | Method* for Addition | Layer and Amount Added ($g/m^2$) 1st Layer | 2nd Layer | 3rd Layer | 4th Layer | 5th Layer | 6th Layer | Sum of Substituent Constant |
|---|---|---|---|---|---|---|---|---|---|
| 101 | — | — | — | — | — | — | — | — | — |
| 102 | (1)* | A | 0.03 | — | 0.03 | — | 0.04 | — | −0.30 |
| 103 | (2)* | A | 0.03 | — | 0.03 | — | 0.04 | — | 3.95 |
| 104 | AP-1 | A | 0.03 | — | 0.03 | — | 0.04 | — | 0.61 |
| 105 | " | B | 0.03 | — | 0.03 | — | 0.04 | — | " |
| 106 | AP-11 | A | — | 0.05 | — | 0.05 | — | — | 0.93 |
| 107 | " | A | — | 0.10 | — | 0.10 | — | — | " |
| 108 | AP-13 | A | 0.05 | — | 0.05 | — | 0.05 | — | 0.35 |
| 109 | " | B | — | 0.05 | — | 0.05 | — | 0.05 | " |
| 110 | AP-17 | A | 0.03 | — | 0.03 | — | 0.04 | — | 1.65 |
| 111 | " | A | 0.05 | — | 0.05 | — | 0.07 | — | " |
| 112 | " | B | — | — | — | 0.1 | — | — | " |

*A: Emulcified dispersion method
*B: Fine particle dispersion method

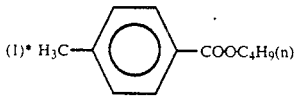

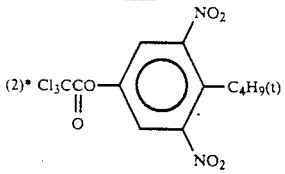

The multilayer color light-sensitive materials as described above (Light-Sensitive Materials 101 to 112) were exposed to light through a color separation filter of B, G, R and grey, the density of each of which continuously changes, for 1/10 second at 5,000 lux using a tungsten lamp. The emulsion side surface of the exposed light-sensitive material transported at a line speed of 20 mm/sec. was supplied water at a rate of 15 ml/m$^2$ by a wire bar and then immediately superimposed on the dye fixing material in such a manner that their coated layers were in contact with each other. These materials were heated for 15 seconds using a heat roller which had been so adjusted that the temperature of the layers absorbed water became 85° C.

Then, the dye fixing material was peeled apart from the light-sensitive material, whereupon clear blue, green, red and grey images without unevenness were obtained in the dye fixing material corresponding to the color separation filter of B, G, R and grey, respectively.

Further, Light-Sensitive Materials 101 to 112 were preserved under conditions of 40° C. and 70% RH (relative humidity) for 7 days, and then subjected to exposure to light and development processing in the same manner as described above.

With Light-Sensitive Materials 101 to 112 both before and after the preservation, the maximum density ($D_{max}$) and the minimum density ($D_{min}$) of each cyan, magneta and yellow color at the grey area were measured.

The results obtained thereby are shown in Table 4 below.

TABLE 4

| Light-Sensitive Material | Remark | $D_{max}$ Cyan | $D_{max}$ Magenta | $D_{max}$ Yellow | $D_{min}$ Cyan | $D_{min}$ Magenta | $D_{min}$ Yellow |
|---|---|---|---|---|---|---|---|
| Before Preservation | | | | | | | |
| 101 | Comparison | 2.05 | 2.20 | 2.02 | 0.12 | 0.18 | 0.15 |
| 102 | " | 2.03 | 2.15 | 1.96 | 0.11 | 0.17 | 0.14 |
| 103 | " | 1.85 | 1.90 | 1.66 | 0.12 | 0.18 | 0.15 |
| 104 | Present Invention | 2.05 | 2.20 | 2.02 | 0.12 | 0.18 | 0.15 |
| 105 | Present Invention | 2.05 | 2.21 | 2.01 | 0.12 | 0.17 | 0.15 |
| 106 | Present Invention | 2.04 | 2.20 | 2.01 | 0.12 | 0.18 | 0.15 |
| 107 | Present Invention | 2.05 | 2.20 | 2.01 | 0.12 | 0.18 | 0.14 |
| 108 | Present Invention | 2.04 | 2.19 | 2.02 | 0.12 | 0.18 | 0.15 |
| 109 | Present Invention | 2.05 | 2.21 | 2.02 | 0.12 | 0.18 | 0.15 |
| 110 | Present Invention | 2.04 | 2.21 | 2.01 | 0.12 | 0.17 | 0.15 |
| 111 | Present Invention | 2.05 | 2.20 | 2.02 | 0.12 | 0.18 | 0.15 |
| 112 | Present Invention | 2.05 | 2.20 | 2.02 | 0.12 | 0.18 | 0.15 |
| After Preservation | | | | | | | |
| 101 | Comparison | 2.05 | 2.19 | 2.01 | 0.17 | 0.22 | 0.20 |
| 102 | " | 2.02 | 2.14 | 1.95 | 0.18 | 0.21 | 0.19 |
| 103 | " | 1.85 | 1.87 | 1.60 | 0.14 | 0.20 | 0.16 |
| 104 | Present Invention | 2.05 | 2.20 | 2.01 | 0.14 | 0.20 | 0.17 |
| 105 | Present Invention | 2.04 | 2.21 | 2.02 | 0.14 | 0.19 | 0.17 |
| 106 | Present Invention | 2.05 | 2.20 | 2.01 | 0.14 | 0.20 | 0.17 |
| 107 | Present Invention | 2.05 | 2.19 | 2.02 | 0.15 | 0.19 | 0.17 |
| 108 | Present Invention | 2.04 | 2.21 | 2.01 | 0.14 | 0.19 | 0.17 |
| 109 | Present Invention | 2.05 | 2.20 | 2.02 | 0.14 | 0.20 | 0.16 |
| 110 | Present Invention | 2.05 | 2.21 | 2.01 | 0.14 | 0.19 | 0.17 |
| 111 | Present Invention | 2.05 | 2.20 | 2.01 | 0.14 | 0.20 | 0.17 |
| 112 | Present Invention | 2.05 | 2.21 | 2.01 | 0.14 | 0.20 | 0.17 |

From the results shown in Table 4, it can be seen that the heat-developable light-sensitive materials according to the present invention exhibit excellent and superior properties.

EXAMPLE 2

A method for preparation of a silver halide emulsion for the hereinafter described fifth layer and the first layer is described below.

600 ml of an aqueous solution containing sodium chloride and potassium bromide and an aqueous solution of silver nitrate which had been prepared by dissolving 0.59 mol of silver nitrate in 600 ml of water were simultaneously added to an aqueous solution of gelatin, which had been prepared by dissolving 20 g of gelatin and 3 g of sodium chloride in 1,000 ml of water and maintained at a temperature of 75° C., at the same addition rate over a period of 40 minutes while the aqueous solution of gelatin was being vigorously stirred. Thus, a monodisperse cubic silver chlorobromide emulsion (bromide content: 50 mol %) having an average particle size of 0.40 μm was prepared.

After being washed with water and desalted, the emulsion was chemically sensitized with 5 mg of sodium thiosulfate and 20 mg of 4-hydroxy-6-methyl-1,3,3a,7-tetraazaindene at a temperature of 60° C. The yield of the emulsion was 600 g.

A method for preparation of a silver halide emulsion for the hereinafter described third layer is described below.

600 ml of an aqueous solution containing sodium chloride and potassium bromide, an aqueous solution of silver nitrate, which had been prepared by dissolving 0.59 mol of silver nitrate in 600 ml of water, were simultaneously added to an aqueous solution of gelatin, which had been prepared by dissolving 20 g of gelatin and 3 g of sodium chloride in 1,000 ml of water and maintained at a temperature of 75° C., at the same addition rate over a period of 40 minutes while the aqueous solution of gelatin was being stirred vigorously. Thus, a monodisperse cubic silver chlorobromide emulsion (bromide content: 80 mol %) having an average particle size of 0.35 μm was prepared.

After being washed with water and desalted, the emulsion was chemically sensitized with 5 mg of sodium thiosulfate and 20 mg of 4-hydroxy-6-methyl-1,3,3a,7-tetraazaindene at a temperature of 60° C. The yield of the emulsion was 600 g.

A method for preparation of silver benzotriazole emulsion is described below.

28 g of gelatin and 13.2 g of benzotriazole were dissolved in 300 ml of water. The resulting solution was then stirred with the temperature kept at 40° C. A solution containing 17 g of silver nitrate dissolved in 100 ml of water was added to the solution over a period of 2 minutes. The pH of the emulsion thus prepared was properly adjusted to flocculate. The excess salts were then removed. Then, the pH of the emulsion was adjusted to 6.30 to obtain 400 g of benzotriazole emulsion.

A method for preparation of acetylene silver emulsion is described below.

20 g of gelatin and 4.6 g of 4-acetylaminophenyl acetylene were dissolved in 1,000 ml of water and 200 ml of ethanol. The resulting solution was then stirred with the temperature thereof maintained at 40° C. A solution containing 4.5 g of silver nitrate dissolved in 200 ml of water was added to the solution over a period of 5 minutes. The pH of the dispersion thus prepared was properly adjusted to flocculate. The excess salts were then removed. Then, the pH of the dispersion was adjusted to 6.3 to obtain 300 g of the dispersion of acetylene silver compound.

A method for preparation of a gelatin dispersion of dye providing compound is described below.

A mixture of 5 g of Yellow dye providing compound (4) described below, 0.2 g of auxiliary developing agent (A) described below, 0.2 g of antifogging agent (B) described below, 0.5 g of sodium 2-ethylhexylsulfosuccinate as a surface active agent, 2.5 g of triisononyl phosphate and 30 ml of ethyl acetate was heated at about 60° C. to form a uniform solution. The resulting solution was mixed while stirring with 100 g of a 3% aqueous solution of lime-processed gelatin, and the mixture was then dispersed by means of a homogenizer at 10,000 rpm for 10 minutes. The dispersion thus obtained was designated a dispersion of yellow dye providing compound.

Auxiliary developing agent (A)

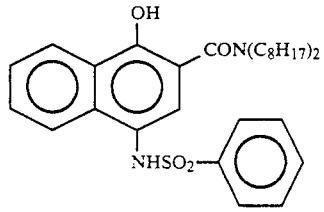

Antifogging agent (B)

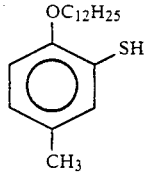

A dispersion of magenta dye providing compound was prepared in the same manner as described for the preparation of dispersion of yellow dye providing compound except for using Magenta dye providing compound (5) described below instead of Yellow dye providing compound (4) and 2.5 g of tricresyl phosphate as a high boiling solvent.

Further, a dispersion of cyan dye providing compound was prepared in the same manner as described for the preparation of dispersion of yellow dye providing compound except for using Cyan dye providing compound (6) described below instead of Yellow dye providing compound (4).

Using the components described above, a multilayer heat-developable light-sensitive material (Light-Sensitive Material 201) as described in Table 5 below was prepared. In following Table 5, the coating amount of each component is set forth in parentheses.

TABLE 5

| | |
|---|---|
| Sixth Layer | Gelatin (800 mg/m$^2$), Hardening agent*3 (16 mg/m$^2$), Silica*5 (100 mg/m$^2$), Zinc hydroxide (300 mg/m$^2$) |
| Fifth Layer (Green-sensitive emulsion layer) | Silver chlorobromide emulsion (bromide: 50 mol %, silver: 400 mg/m$^2$), Silver benzotriazole emulsion (silver: 20 mg/m$^2$), Sensitizing dye D-1 ($1 \times 10^{-6}$ mol/m$^2$), Hardening agent*3 (16 mg/m$^2$), Yellow dye providing compound (4) (400 mg/m$^2$), Gelatin (1400 mg/m$^2$), High boiling solvent*4 (200 mg/m$^2$), Surface active agent*2 (100 mg/m$^2$) |
| Fourth Layer (Intermediate layer) | Gelatin (900 mg/m$^2$), Hardening agent*3 (18 mg/m$^2$), Zinc hydroxide (300 mg/m$^2$) |
| Third Layer (Red-sensitive emulsion layer) | Silver chlorobromide emulsion (bromide: 80 mol %, Silver: 300 mg/m$^2$), Acetylene silver emulsion (silver: 60 mg/m$^2$), Silver benzotriazole emulsion (silver: 20 mg/m$^2$), Sensitizing dye D-2 ($8 \times 10^{-7}$ mol/m$^2$), Hardening agent*3 (18 mg/m$^2$), Magenta dye providing compound (5) (400 mg/m$^2$), Gelatin (800 mg/m$^2$), High boiling solvent*1 (200 mg/m$^2$), Surface active agent*2 (100 mg/m$^2$) |

TABLE 5-continued

| | |
|---|---|
| Second Layer (Intermediate layer) | Gelatin (800 mg/m$^2$), Hardening agent*3 (16 mg/m$^2$), Zinc hydroxide (300 mg/m$^2$) |
| First Layer (infrared-sensitive emulsion layer) | Silver chlorobromide emulsion (bromide: 50 mol %, silver: 300 mg/m$^2$), Acetylene silver emulsion (silver: 25 mg/m$^2$), Silver benzotriazole emulsion (silver: 50 mg/m$^2$), Sensitizing dye D-3 ($1 \times 10^{-8}$ mol/m$^2$), Hardening agent*3 (16 mg/m$^2$), Cyan dye providing compound (6) (300 mg/m$^2$), Gelatin (600 mg/m$^2$), High boiling solvent*4 (150 mg/m$^2$), Surface active*2 (100 mg/m$^2$) |
| Support | Support*1 |
| Construction | |

Support*1

Polyethylene terephthalate film (thickness: 180 μm)

Surface Active Agent*2

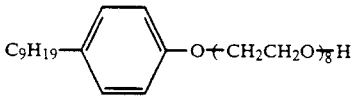

Hardening Agent*3

1,2-Bis(vinylsulfonylacetamido)ethane

High boiling Solvent*4

$(iso\text{-}C_9H_{19}O)_3P{=}O$

Silica*5

Size: 4 μm

Yellow Dye providing compound (4)

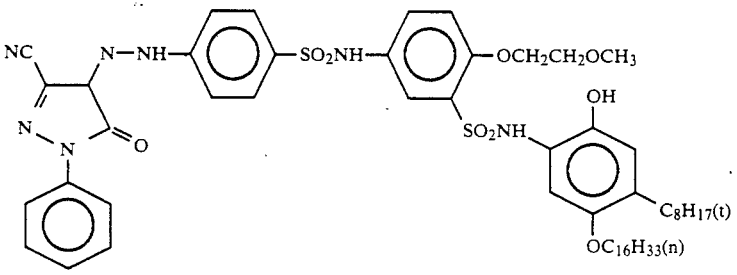

Magenta Dye providing compound (5)

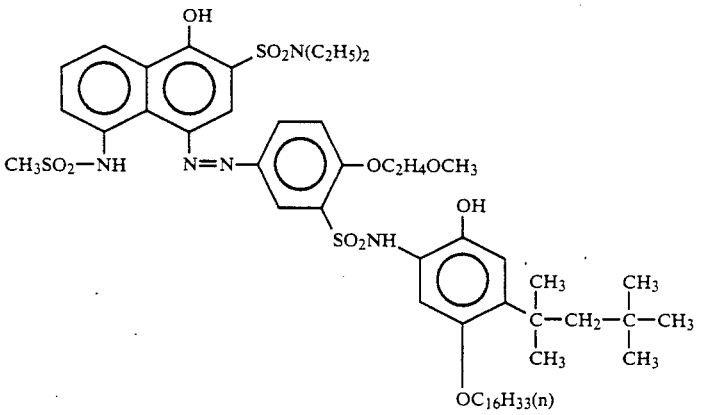

Cyan Dye providing compound (6)

TABLE 5-continued

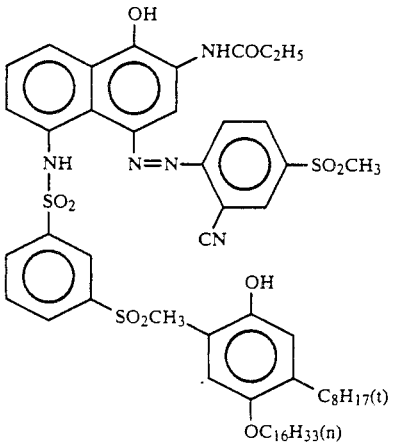

Sensitizing dye (D-1)

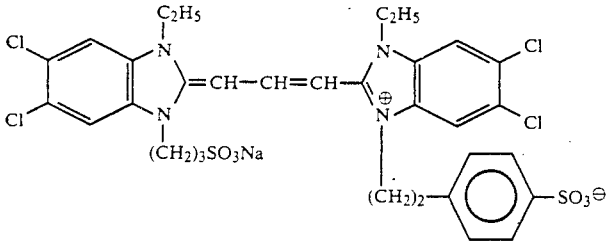

Sensitizing dye (D-2)

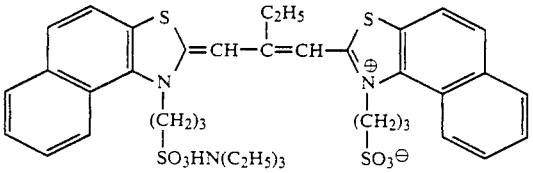

Sensitizing dye (D-3)

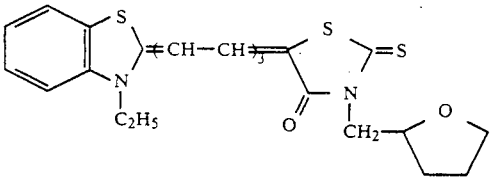

Light-Sensitive Materials 202 to 207 were prepared in the same manner as described for Light-Sensitive Material 201 described above, except for adding the acid precursor or comparative compound as shown in Table 6 below, respectively.

Light-Sensitive Materials 201 to 207 prepared as described above were exposed to light through a three color separation filter of G, R and IR (G: filter transmitting a wavelength band of 500 nm to 600 nm, R: filter transmitting a wavelength band of 600 nm to 700 nm, IR: filter transmitting a wavelength band of 700 nm or higher), the density of each of which continuously changes, for 1 second at 500 lux using a tungsten lamp.

The emulsion side surface of the heat-developable light-sensitive material exposed in this manner was then supplied with 12 ml/m$^2$ of water through a wire bar. The light-sensitive material was then superimposed on Dye Fixing Material R-1 described above in Example 1 in such a manner that the coated layers thereof were brought into contact with each other.

The lamination was then heated for 30 seconds by means of a heat roller whose temperature had been adjusted to keep the temperature of the layers adsorbed water at 93° C. The dye fixing material was then peeled off the light-sensitive material to obtain on the dye fixing material clear yellow, magenta and cyan images corresponding to the three color separation filter of G, R and IR.

TABLE 6

| Light-Sensitive Material | Acid Precursor or Comparative Compound | Method* for Addition | Layer and Amount Added ($g/m^2$) 1st Layer | 2nd Layer | 3rd Layer | 4th Layer | 5th Layer | 6th Layer | Sum of Substituent Constant |
|---|---|---|---|---|---|---|---|---|---|
| 201 | — | — | — | — | — | — | — | — | — |
| 202 | (3)* | A | 0.10 | — | 0.10 | — | 0.10 | — | −0.265 |
| 203 | " | A | 1.0 | — | 1.0 | — | 1.0 | — | " |
| 204 | AP-18 | A | 0.05 | — | 0.05 | — | 0.08 | — | 0.54 |
| 205 | " | A | — | 0.09 | — | 0.09 | — | — | " |
| 206 | AP-21 | A | 0.03 | — | 0.03 | — | 0.04 | — | 0.98 |
| 207 | " | B | — | — | — | — | — | 0.10 | " |

*A: Emulcified dispersion method same as Example 1
*B: Fine particles dispersion method same as Example 1

*(3) $C_3H_7COO$— 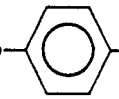 —$C_2H_5$

Light-Sensitive Materials 201 to 207 were preserved under conditions of 40° C. and 70% RH for 7 days, and then subjected to exposure to light and development processing in the same manner as described above.

With each of these samples, $D_{max}$ and $D_{min}$ of each color were measured. The results obtained are shown in Table 7 below.

TABLE 7

| Light-Sensitive Material | Remark | $D_{max}$ Cyan | Magenta | Yellow | $D_{min}$ Cyan | Magenta | Yellow |
|---|---|---|---|---|---|---|---|
| Before Preservation | | | | | | | |
| 201 | Comparison | 2.30 | 2.20 | 2.02 | 0.13 | 0.11 | 0.11 |
| 202 | " | 2.31 | 2.18 | 2.00 | 0.13 | 0.11 | 0.11 |
| 203 | " | 2.05 | 2.01 | 1.70 | 0.13 | 0.11 | 0.12 |
| 204 | Present Invention | 2.31 | 2.19 | 2.02 | 0.13 | 0.11 | 0.11 |
| 205 | Present Invention | 2.30 | 2.20 | 2.01 | 0.14 | 0.11 | 0.11 |
| 206 | Present Invention | 2.31 | 2.20 | 2.01 | 0.13 | 0.11 | 0.11 |
| 207 | Present Invention | 2.30 | 2.20 | 2.02 | 0.13 | 0.11 | 0.11 |
| After Preservation | | | | | | | |
| 201 | Comparison | 2.31 | 2.20 | 2.01 | 0.16 | 0.13 | 0.14 |
| 202 | " | 2.29 | 2.18 | 2.00 | 0.16 | 0.13 | 0.14 |
| 203 | " | 2.05 | 1.99 | 1.69 | 0.15 | 0.12 | 0.13 |
| 204 | Present Invention | 2.30 | 2.19 | 2.02 | 0.14 | 0.12 | 0.12 |
| 205 | Present Invention | 2.31 | 2.20 | 2.01 | 0.15 | 0.12 | 0.12 |
| 206 | Present Invention | 2.30 | 2.20 | 2.02 | 0.14 | 0.12 | 0.12 |
| 207 | Present Invention | 2.31 | 2.20 | 2.02 | 0.14 | 0.12 | 0.12 |

As is apparent from the results shown in Table 7 above, the light-sensitive materials according to the present invention exhibit excellent and superior properties.

While the invention has been described in detail and with reference to specific embodiments thereof, it will be apparent to one skilled in the art that various changes and modifications can be made therein without departing from the spirit and scope thereof.

What is claimed is:

1. A heat-developable color light-sensitive material comprising a support having thereon at least a light-sensitive silver halide, a binder, a dye providing compound capable of releasing or forming a diffusible dye in correspondence or counter-correspondence to a reaction in which silver halide is reduced to silver, a basic metal salt compound which is sparingly soluble in water, and at least one acid precursor compound represented by formula (I):

$$R^1-\overset{\overset{O}{\|}}{\underset{\underset{O}{\|}}{S}}-O-R^2 \quad \text{(I)}$$

wherein the total number of carbon atoms included in $R^1$ and $R^2$ is at least 10, and $R^1$ and $R^2$ each represents a group represented by formula (III) or formula (IV):

$$-\overset{\overset{R^{11}}{|}}{\underset{\underset{R^{13}}{|}}{C}}-R^{12} \quad \text{(III)}$$

-continued

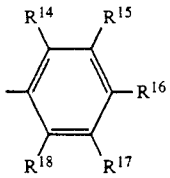

(IV)

wherein $R^{11}$, $R^{12}$, $R^{13}$, $R^{14}$, $R^{15}$, $R^{16}$, $R^{17}$ and $R^{18}$ each represents a substituent, provided that $R^1$ and $R^2$ are selected such that the sum of the aliphatic Taft's constants ($\sigma^*$ value) of the substituents represented by formula (III), the Taft's constants ($\sigma^-$ value) of $R^{14}$ and $R^{18}$, the Hammett's constants ($\sigma_m$ value) of $R^{15}$ and $R^{17}$, and the Hammett's constant ($\sigma_p$ value) of $R^{16}$ is 0 or more.

2. A heat-developable color light-sensitive material as in claim 1, wherein $R^{11}$ and $R^{12}$ combine with each other to form a ring structure.

3. A heat-developable color light-sensitive material as in claim 1, wherein two vicinal groups of those represented by $R^{14}$, $R^{15}$, $R^{16}$, $R^{17}$ and $R^{18}$ combine with each other to form an aromatic ring.

4. A heat-developable color light-sensitive material as in claim 1, wherein the sum of the Taft's constants and the Hammett's constants with respect to the substituents represented by $R^{11}$, $R^{12}$, $R^{13}$, $R^{14}$, $R^{15}$, $R^{16}$, $R^{17}$ and $R^{18}$ is 0 to 3.

5. A heat-developable color light-sensitive material as in claim 1, wherein the substituent represented by $R^{11}$, $R^{12}$, $R^{13}$, $R^{14}$, $R^{15}$, $R^{16}$, $R^{17}$ or $R^{18}$ is selected from a hydrogen atom, a halogen atom, a nitro group, a cyano group, an alkyl group, an alkenyl group, an aralkyl group, an aryl group, a heterocyclic group, an alkoxy group, an aryloxy group, an alkyl or aryl thio group, a substituted or unsubstituted carbamoyl group, an alkyl or aryl carbonyl group, an alkyl or aryl sulfonyl group, an alkyl or aryl oxycarbonyl group, an alkyl or aryl carbonyloxy group, a di-substituted amino group substituted with an alkyl group or an aryl group, and a substituted or unsubstituted sulfamoyl group.

6. A heat-developable color light-sensitive material as in claim 1, wherein the compound represented by formula (I) is contained in a layer wherein said layer is a light-sensitive layer, a protective layer or an intermediate layer.

7. A heat-developable color light-sensitive material as in claim 1, wherein an amount of the compound represented by the formula (I) is in a range from 0.001 mol to 1 mol per mol of the basic metal salt compound.

8. A heat-developable color light-sensitive material as in claim 1, wherein the basic metal salt compound is a basic metal salt having a solubility in water of 0.5 or less at 25° C., wherein the solubility is defined as a gram number of the basic metal salt dissolved in 100 g of water.

9. A heat-developable color light-sensitive material as in claim 8, wherein the basic metal salt compound is a carbonate, a phosphate, a silicate, a borate, an aluminate, a hydroxide, an oxide or a double salt thereof.

10. A heat-developable color light-sensitive material as in claim 6, wherein an amount of the basic metal salt compound is in a range of 50% by weight or less based on the weight of the layer.

11. A heat-developable color light-sensitive material as in claim 1, wherein an average particle size of the basic metal salt compound is 50 $\mu$m or less.

12. A heat-developable color light-sensitive material as in claim 1, wherein the light-sensitive material further contains an organic silver salt oxidizing agent.

13. A heat-developable color light-sensitive material as in claim 1, wherein the light-sensitive material further contains a reducing agent.

14. A heat-developable color light-sensitive material as in claim 1, wherein the dye providing compound is a coupler capable of forming a dye upon an oxidative coupling reaction.

15. A heat-developable color light-sensitive material as in claim 1, wherein the dye providing compound is a compound having a function of releasing or diffusing imagewise a diffusible dye.

16. A heat-developable color light-sensitive material as in claim 15, wherein the dye providing compound is represented by the following general formula (LI):

$$(D—Y)_n—Z \qquad (LI)$$

wherein D represents a dye moiety, a dye moiety which has been temporarily shifted to a shorter wavelength range or a dye precursor moiety; Y represents a simple bond or a connecting group; Z represents a group having such a property that diffusibility of the compound represented by $(D—Y)_n—Z$ can be differentiated in correspondence or counter-correspondence to light-sensitive silver salts having a latent image distributed imagewise or a group having a property of releasing D in correspondence or counter-correspondence to light-sensitive silver salts having a latent image distributed imagewise, and diffusibility of D as released being different from that of the compound represented by $(D—Y)_n—Z$; and n represents 1 or 2 and when n is 2, two D—Y's may be the same or different.

17. A heat-developable color light-sensitive material as in claim 1, wherein the light-sensitive material further contains an image formation accelerating agent.

18. A heat-developable color light-sensitive material as in claim 17, wherein the image formation accelerating agent is a base, a base precursor, a nucleophilic compound, an organic solvent having a high boiling point, a thermal solvent, a surface active agent or a compound capable of interacting with silver or a silver ion.

19. A heat-developable color light-sensitive material as in claim 1, wherein the light-sensitive material comprises a support having thereon at least three silver halide emulsion layers sensitive to different spectral wavelength ranges.

20. A heat-developable color light-sensitive material as in claim 19, wherein each of the at least three silver halide emulsion layers is sensitive to one of blue light, green light, red light and infrared light.

21. A heat-developable color light-sensitive material as in claim 19, wherein each of the at least three silver halide emulsion layers contains one of yellow, magenta and cyan dye providing compounds.

* * * * *